US008306442B2

(12) United States Patent
Matsumoto

(10) Patent No.: US 8,306,442 B2
(45) Date of Patent: Nov. 6, 2012

(54) IMAGE FORMING APPARATUS WITH CONTROL FOR SETTING IMAGE FORMING CONDITION BASED ON EXECUTED MODE

(75) Inventor: Yasuhisa Matsumoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/005,819

(22) Filed: Jan. 13, 2011

(65) Prior Publication Data

US 2011/0110675 A1 May 12, 2011

Related U.S. Application Data

(63) Continuation of application No. 12/409,931, filed on Mar. 24, 2009, now Pat. No. 7,899,347.

(30) Foreign Application Priority Data

Mar. 31, 2008 (JP) ..... 2008-091067
Mar. 6, 2009 (JP) ..... 2009-053706

(51) Int. Cl.
*G03G 15/00* (2006.01)

(52) U.S. Cl. ..... 399/45

(58) Field of Classification Search ..... 399/43, 399/45, 389
See application file for complete search history.

(56) References Cited

U.S. PATENT DOCUMENTS

| | | | |
|---|---|---|---|
| 6,301,452 | B1 | 10/2001 | Yoshizawa |
| 6,668,144 | B2 | 12/2003 | Maruyama |
| 7,046,954 | B2 | 5/2006 | Yokoi |
| 7,130,573 | B2 | 10/2006 | Nakamori |
| 7,558,492 | B2 | 7/2009 | Aoki |
| 2005/0002711 | A1 | 1/2005 | Yokoi |

FOREIGN PATENT DOCUMENTS

| | | |
|---|---|---|
| JP | 2002-182518 | 6/2002 |
| JP | 2003-302885 | 10/2003 |
| JP | 2007-055814 | 3/2007 |

OTHER PUBLICATIONS

Official Letter/Search Report, dated Oct. 21, 2009, issued by the European Patent Office, in European Patent Application No. 09156656.2.

Korean Office Action, dated Jul. 28, 2011, issued in Korean Application No. 10-2011-0068902.

*Primary Examiner* — Hoang Ngo

(74) *Attorney, Agent, or Firm* — Fitzpatrick, Cella, Harper & Scinto

(57) ABSTRACT

In a second mode to form an image based on a pre-designated type of recording medium, a detection is performed to a recording medium which is fed, and in a first mode to form an image based on the detected type, image forming conditions are set based on a result of the sheet type detection in the second mode without executing the sheet type detection.

14 Claims, 17 Drawing Sheets

| FIG. 10A | FIG. 10B |
|---|---|

| FIG. 13A | FIG. 13B |
|---|---|

| FIG. 16A | FIG. 16B |
|---|---|

IMAGE FORMING APPARATUS WITH CONTROL FOR SETTING IMAGE FORMING CONDITION BASED ON EXECUTED MODE

This is a continuation of U.S. patent application Ser. No. 12/409,931, filed Mar. 24, 2009, and allowed Oct. 14, 2010.

BACKGROUND OF THE INVENTION

1. Field of the Invention

The present invention relates to an image forming apparatus for detecting information regarding characteristics or a type of a sheet material on which an image is formed and controlling an image forming operation based on a detection result and to a control method of the image forming apparatus.

2. Description of the Related Art

As image forming apparatuses for forming an image based on an image signal, various systems such as electrophotographic system and ink-jet system are conventionally used. In such image forming apparatuses, at present, there are a variety of print sheets (sheet materials) as media to be printed. Media having various features such as size, transmittancy, and glossiness exist. From such a background, in order to obtain high image quality, it is necessary to optimally form images to various kinds of media.

The image forming apparatus of the electrophotographic system such as copying apparatus or laser printer has a latent image holding material, a developing apparatus, a transfer unit, and a fixing apparatus. The latent image holding material holds a latent image. The developing apparatus visualizes the held latent image as a developer image by applying a developer to the latent image holding material. The transfer unit transfers the developer image visualized by the developing apparatus onto the sheet material which is conveyed in a predetermined direction. The fixing apparatus fixes the developer image onto the sheet material by heating and pressurizing the sheet material on which the developer image has been transferred by the transfer unit under predetermined fixing processing conditions.

Hitherto, in the image forming apparatus, when the printing operation is executed, a size and a type (hereinbelow, also referred to as a sheet type) of the sheet material can be arbitrarily set by the user from an operation panel provided for a main body of the image forming apparatus or from a host computer connected to the image forming apparatus (hereinbelow, such a mode is referred to as a "designating mode"). According to the settings, for example, in the case of the foregoing image forming apparatus of the electrophotographic system, control to change an image forming condition such as developing condition, transfer condition, or fixing processing conditions (for example, a fixing temperature and a conveying speed of the sheet material which passes through the fixing apparatus) is made.

However, the user does not certainly make the setting of the sheet type mentioned above. Therefore, particularly, in an image forming apparatus for business use, a print mode adapted to automatically discriminate the sheet type and set the image forming conditions based on the detection result (hereinbelow, such a mode is referred to as an automatic mode) is prepared.

For example, Japanese Patent Application Laid-Open No. 2002-182518 and Japanese Patent Application Laid-Open No. 2003-302885 have presented the following apparatuses. There is an apparatus in which the sheet type is automatically discriminated by a method whereby a surface image of a stopped sheet material is photographed by a CMOS (Complementary Metal Oxide Semiconductor) sensor and a surface smoothness of the sheet material is detected, and the developing condition, transfer condition, or fixing condition is variably controlled according to a discrimination result. Further, an apparatus in which a light emitting source is arranged at a position which faces a sensor for automatically discriminating the sheet type and transmitted light is detected, thereby discriminating the sheet type based on the transmitted light (discriminating a thickness of sheet material) has also been proposed. By using such a sheet type discriminating method, control is made so as to perform the discrimination each time the sheet material is fed (control is made so as to automatically discriminate all of the sheet types) or control is made so as to perform the discrimination only about the first sheet of a print job and to omit the discrimination about the subsequent sheets.

In Japanese Patent Application Laid-Open No. 2007-055814, by using such a sheet type discriminating method, the types of a predetermined number of sheets are detected, discriminated, and decided, and a sheet type discrimination result is stored every sheet feed port. After the sheet types were discriminated, in a print job which is printed after the sheet types were decided, control is made based on the discrimination results (sheet types) which have previously been stored. By using such a method, a deterioration in throughput that is caused by the sheet type discriminating process is reduced.

SUMMARY OF THE INVENTION

According to the above related arts, when the automatic mode is set, since the operation to detect the types of the predetermined number of sheet materials is executed, there is such a problem that a productivity when the automatic mode has been set deteriorates.

The invention is made by considering the foregoing problems and it is an object of the invention to provide an image forming apparatus in which by making a sheet type discrimination even in a case other than the case where an automatic mode has been set, while reducing an influence that is exerted on a productivity, a good image can be obtained.

To accomplish the above object, according to the invention, there is provided an image forming apparatus which can select a first mode for detecting a type of recording medium which is fed and forming an image based on the detected type and a second mode for forming the image based on a pre-designated type of recording medium, comprising: a feeding unit which feeds the recording medium; a detecting unit which detects the type of the recording medium which is fed; an image forming unit which forms the image onto the recording medium; and a control unit which sets image forming conditions of the image forming unit based on the type of the recording medium detected by the sheet type detecting unit or the pre-designated sheet type, wherein when the second mode is selected, the control unit executes the operation for detecting the type by the sheet type detecting unit to the recording medium which is fed and, when the first mode is selected, the control unit sets the image forming conditions based on a detection result of the sheet type detecting unit in the second mode without executing the detection by the sheet type detecting unit.

According to the invention, there is provided a control method of an image forming apparatus which can select a first mode for detecting a type of recording medium which is fed and forming an image based on the detected type and a second mode for forming the image based on a pre-designated type of recording medium, comprising the steps of: detecting the type of the recording medium in the second mode; and setting image forming conditions based on a detection result in the second mode without executing the detection of the type of the recording medium in the first mode.

Further features of the present invention will become apparent from the following description of exemplary embodiments with reference to the attached drawings.

BRIEF DESCRIPTION OF THE DRAWINGS

FIGS. 9A and 9B are diagrams for describing the conveying operation of the sheet material which is executed until the fed sheet material reaches a secondary transfer position according to the embodiment 1, in which FIG. 9A illustrates a case where the sheet type discriminating operation is executed every sheet material and FIG. 9B illustrates a case where the sheet type discriminating operation is executed only to the first sheet material of a print job.

FIGS. 12A, 12B, and 12C are diagrams for describing the conveying operation of the sheet material which is executed until the fed sheet material reaches the secondary transfer position according to the embodiment 2, in which FIG. 12A illustrates a case where throughput-down control is not applied, FIG. 12B illustrates a case where the throughput-down control is applied, and FIG. 12C illustrates a case where the throughput-down control is applied and the sheet type discriminating operation is executed.

FIGS. 15A and 15B are diagrams for describing the conveying operation of the sheet material which is executed until the fed sheet material reaches the secondary transfer position according to the embodiment 3, in which FIG. 15A illustrates a case where a post-rotation extending command is received and FIG. 15B illustrates a case where the post-rotation extending command is received and the sheet type discriminating operation is executed.

DESCRIPTION OF THE EMBODIMENTS

Exemplary embodiments of the invention will be illustratively described in detail hereinbelow with reference to the drawings. However, component elements disclosed in the embodiments are merely illustrated as examples and the technical scope of the invention is specified by the scope of Claims and is not limited by the following individual embodiments.

A best mode for carrying out the invention will be described in detail hereinbelow by the embodiments.

Embodiment 1

In the embodiment, an image forming apparatus which can select an automatic mode (first mode) and a designating mode (second mode) will be described. Even when the designating mode has been designated, if it is determined that the sheet type discrimination can be executed without exerting an influence on a throughput, the sheet type discriminating operation is executed and a discrimination result is preliminarily stored. The following describes the image forming apparatus in which the influence which is exercised on the throughput in the case where the automatic mode has been designated is thus minimized as much as possible. An embodiment 1 to which the invention can be applied will be described with reference to FIGS. 1 to 10.

<Construction of Whole Laser Printer>

An outline of an arrangement of a whole laser printer as an image forming apparatus to form an image onto a sheet material as a recording medium will now be described with reference to FIG. 1.

Figure 1:
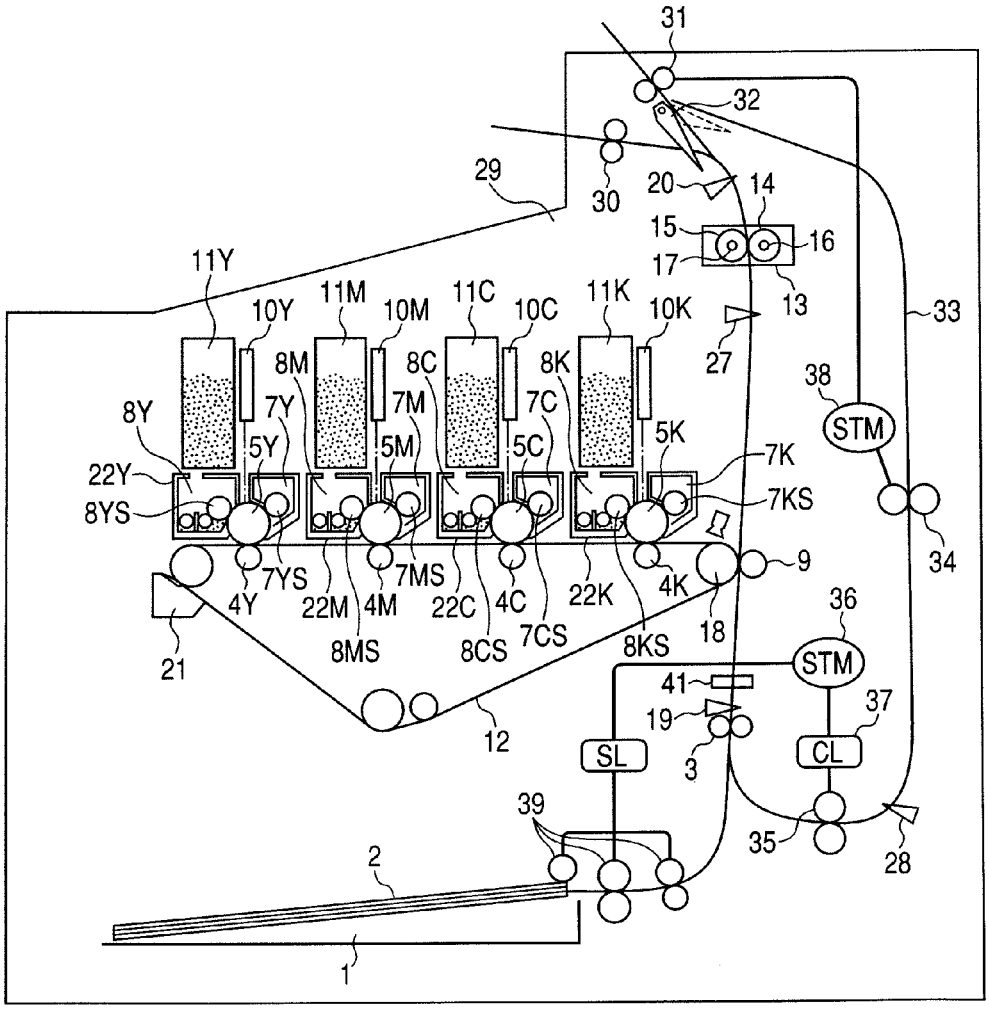
FIG. 1 is a whole constructional diagram of an image forming apparatus according to embodiments 1 to 3.

According to the laser printer, as illustrated in FIG. 1, an electrostatic latent image is formed in an image forming unit from image light which is formed based on an image signal transmitted from a controller unit (not shown), the electrostatic latent image is developed, and a visible image is multiplexed and transferred, thereby forming a color visible image. The color visible image is transferred onto a sheet material 2. The color visible image on the sheet material 2 is fixed. The image forming unit is constructed as follows. That is, the image forming unit includes: photosensitive drums 5Y, 5M, 5C, and 5K of respective stations of the number as many as the number of developing colors which are arranged in parallel; injection charging units 7Y, 7M, 7C, and 7K as primary charging units; developing units 8Y, 8M, 8C, and 8K; and toner cartridges 11Y, 11M, 11C, and 11K. The image forming unit further includes: an intermediate transfer belt 12 as an intermediate transfer member; a sheet feeding unit; a transfer unit; and a fixing unit 13.

The photosensitive drums 5Y, 5M, 5C, and 5K, the injection charging units 7Y, 7M, 7C, and 7K, and the developing units 8Y, 8M, 8C, and 8K are mounted in process cartridges 22Y, 22M, 22C, and 22K which are detachable to the image forming apparatus main body, respectively.

Each of the photosensitive drums 5Y, 5M, 5C, and 5K is constructed by coating an outer periphery of an aluminum cylinder with an organic photoconductive layer. A driving force of a driving motor (not shown) is transferred to each of the photosensitive drums 5Y, 5M, 5C, and 5K, so that each drum is rotated. The driving motor rotates the photosensitive drums 5Y, 5M, 5C, and 5K clockwise according to the image forming operation. Exposure light to the photosensitive drums 5Y, 5M, 5C, and 5K is emitted from scanner units 10Y, 10M, 10C, and 10K and is selectively exposed to the surfaces of the photosensitive drums 5Y, 5M, 5C, and 5K, so that the electrostatic latent image is formed.

The four injection charging units 7Y, 7M, 7C, and 7K as primary charging units charge the photosensitive drums 5Y, 5M, 5C, and 5K of yellow (Y), magenta (M), cyan (C), and black (K) every station. Sleeves 7YS, 7MS, 7CS, and 7KS are provided for the injection charging units 7Y, 7M, 7C, and 7K, respectively.

The four developing units 8Y, 8M, 8C, and 8K as developing devices perform development of yellow (Y), magenta (M), cyan (C), and black (K) every station in order to visualize the electrostatic latent images. Sleeves 8YS, 8MS, 8CS, and 8KS are provided for the developing units 8Y, 8M, 8C, and 8K, respectively. The developing units are detachably attached, respectively.

Since the intermediate transfer belt 12 is in contact with the photosensitive drums 5Y, 5M, 5C, and 5K, the belt is rotated in association with the rotations of the photosensitive drums 5Y, 5M, 5C, and 5K. The intermediate transfer belt 12 receives the transfer of the visible images by primary transfer biases applied to primary transfer rollers 4Y, 4M, 4C, and 4K, so that the visible images are formed onto the belt. By sandwiching and conveying the sheet material 2 at a position (secondary transfer position) of a secondary transfer roller 9, the color visible image is simultaneously multiplexed and transferred onto the sheet material 2. A driving roller 18 drives the intermediate transfer belt 12. A cleaner 21 cleans toner remaining on the intermediate transfer belt 12 and collects it.

The fixing unit 13 fixes the transferred color visible image while the sheet material 2 is conveyed. The fixing unit 13 has: a fixing roller 14 for heating the sheet material 2; and a pressure roller 15 for allowing the sheet material 2 to be come into pressure contact with the fixing roller 14. Each of the fixing roller 14 and the pressure roller 15 is formed in a hollow shape. Heaters 16 and 17 are built in the rollers 14 and 15, respectively. That is, while the sheet material 2 which holds the color visible image is conveyed by the fixing roller 14 and the pressure roller 15, by applying a heat and a pressure to the sheet material 2, the toner is fixed onto the surface of the sheet material. After the color visible image was fixed, the sheet material 2 is ejected to a discharge unit by a discharge roller 30 and the image forming operation is finished.

An engine control unit 303 (refer to FIG. 2) (not shown) in FIG. 1 manages a conveyance condition based on detection signals from a registration sensor 19, a pre-fixing sensor 27, a fixing discharge sensor 20, and a duplex conveyance sensor 28 arranged on a transfer material conveying path. Further, a sheet feed cassette and a registration roller 3 are provided. The registration roller 3 is a roller for allowing the image on the intermediate transfer belt 12 to be transferred to a proper position of the sheet material 2, that is, it is a roller for temporarily stopping the sheet material 2 and allowing the sheet material 2 to be synchronized with the image. The image forming apparatus also has: an image forming apparatus 29; a reverse roller 31; a flapper 32 for switching the conveying path; a duplex conveying path 33; and a conveying roller 34 for conveying the sheet material 2 on the duplex conveying path 33. The image forming apparatus further has: a conveying roller 35 for conveying the sheet material 2 again from the duplex conveying path 33 to the secondary transfer position again; stepping motors 36 and 38 for driving the rollers; a clutch 37 which is turned on in the case of conveying the sheet material in a duplex print mode and drives the conveying roller 35; and a sheet feeding and conveying roller group (rollers for feeding the sheet material) 39.

A sheet material discriminating apparatus 41 is arranged at a position just after the registration sensor 19. After the fed sheet material 2 passed through the registration sensor 19, it is temporarily stopped after a predetermined time. In this state, the sheet material discriminating apparatus 41 executes the detecting operation for discriminating the type of sheet material 2. Such a temporary stop becomes a cause for deterioration in throughput.

<System Construction and Interface of Laser Printer>

Subsequently, a system construction and an interface of the laser printer will be described.

Figure 2:
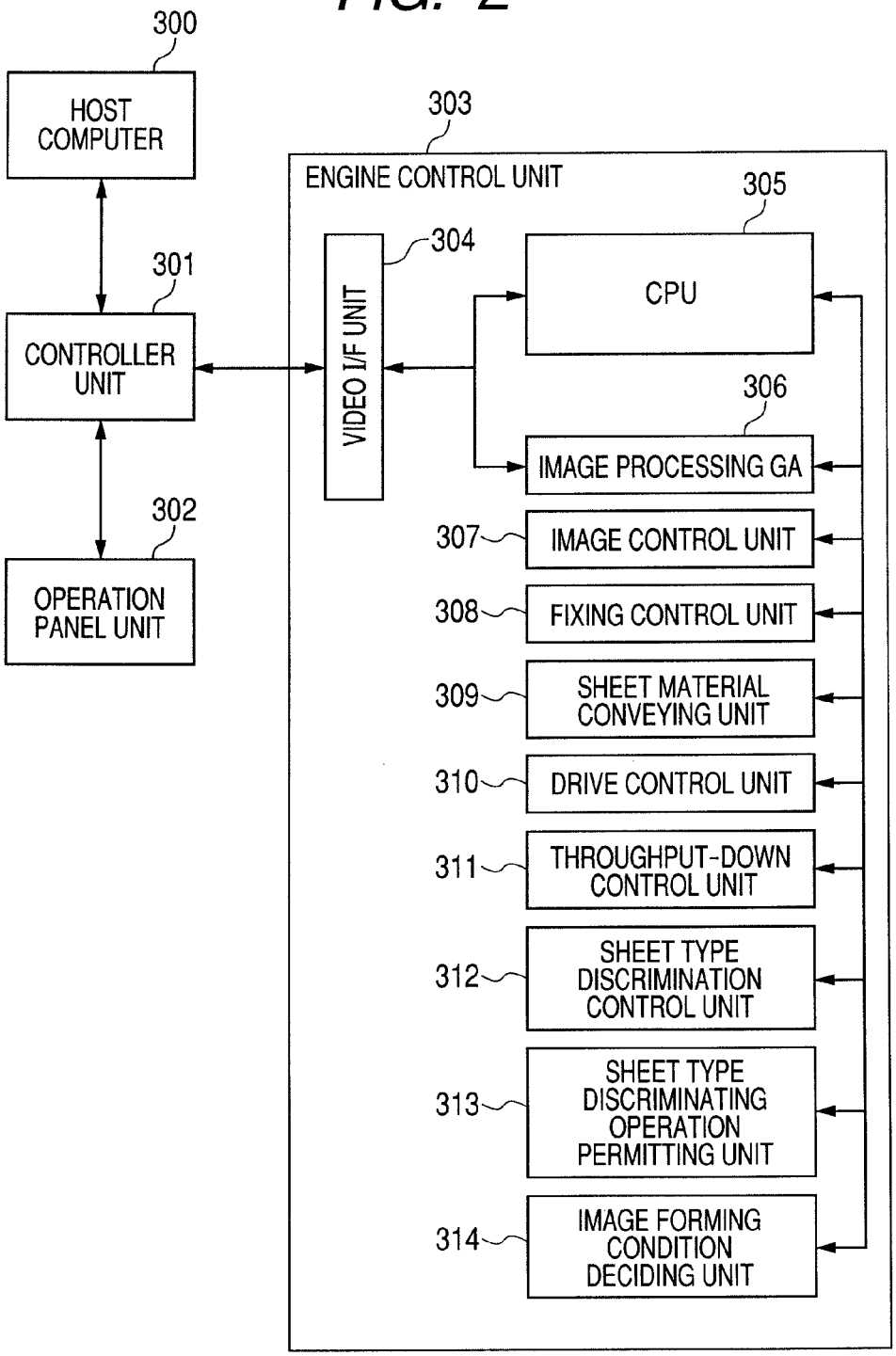
FIG. 2 is a block diagram illustrating a system construction of the image forming apparatus according to the embodiments 1 to 3.

FIG. 2 is a block diagram illustrating the system construction around the printer illustrated in FIG. 1. A host computer 300, a controller unit 301, an operation panel unit 302, and the engine control unit 303 are illustrated. The engine control unit 303 is constructed as follows. First, the engine control unit 303 has: a video interface unit 304; a CPU (Central Processing Unit) 305; an image processing GA (Genetic Algorithm) 306; an image control unit 307; and a fixing control unit 308. The engine control unit 303 further has: a sheet material conveying unit 309; a drive control unit 310; a throughput-down control unit 311; a sheet type discrimination control unit 312; a sheet type discriminating operation permitting unit 313; and an image forming condition deciding unit 314.

The controller unit 301 can mutually communicate with the host computer 300, engine control unit 303, and operation panel unit 302.

Figure 3:
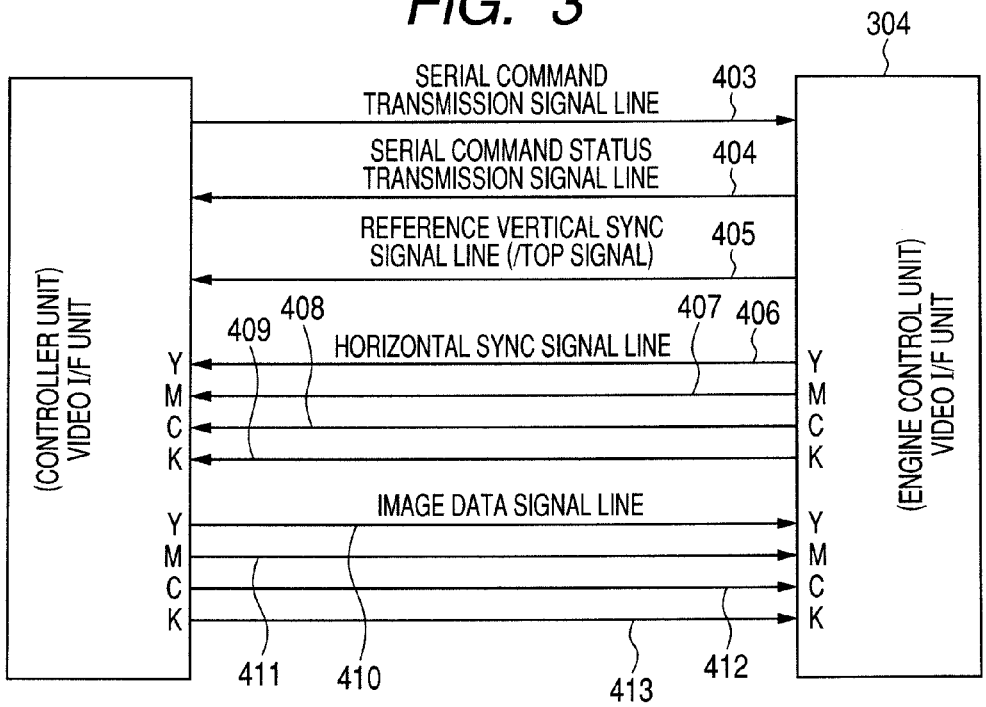
FIG. 3 is a diagram for describing interface signals of each of an engine control unit and a controller unit according to the embodiments 1 to 3.

With respect to interface signals of the engine control unit 303 and the controller unit 301:

FIG. 3 is a diagram illustrating the interface signals of each of the engine control unit 303 and the controller unit 301.

In FIG. 3, a serial command transmission signal line 403 transmits a command from the controller unit 301 to the engine control unit 303. A serial command status transmission signal line 404 transmits a status data from the engine control unit 303 to the controller unit 301 by serial communication in response to the command.

A reference vertical sync signal line 405 transmits a reference vertical sync signal (/TOP signal) from the engine control unit 303 to the controller unit 301. A Y horizontal sync signal line 406 transmits a yellow horizontal sync signal from the engine control unit 303 to the controller unit 301. Similarly, M, C, and K horizontal sync signal lines 407, 408, and 409 transmit magenta, cyan, and black horizontal sync signals from the engine control unit 303 to the controller unit 301, respectively. In FIG. 3, a "horizontal sync signal line" is shown only for the Y horizontal sync signal line 406.

A Y image data signal line 410 transmits a yellow image data signal from the controller unit 301 to the engine control unit 303. Similarly, M, C, and K image data signal lines 411, 412, and 413 transmit magenta, cyan, and black image data signals from the controller unit 301 to the engine control unit 303, respectively. In FIG. 3, an "image data signal line" is shown only for the Y image data signal line 410.

The controller unit 301 receives image information and a print command from the host computer 300, analyzes the received image information, and converts into bit data. A print reservation command, a print start command, and a video signal are transmitted to the engine control unit 303 every sheet material through a video interface unit (not shown) of the controller unit 301.

The controller unit 301 transmits the print reservation command to the engine control unit 303 in response to a print command from the host computer 300. The controller unit 301 transmits the print start command to the engine control unit 303 at timing when the apparatus enters a printable state.

The engine control unit 303 makes a print execution preparation in order of the print reservation commands from the controller unit 301 and waits for the print start command from the controller unit 301. When a print instruction signal is received, the engine control unit 303 outputs the /TOP signal serving as reference timing for output of the video signal to the controller unit 301 and starts the printing operation according to the print reservation commands.

<Print Mode>

Subsequently, the print mode will be described.

In the image forming apparatus, it is necessary to form images to various different kinds of sheet materials. Since the sheet materials have various characteristics, it is necessary to optimize the image forming conditions such as transfer condition, fixing condition, and further, conveying speed of the sheet material 2 in accordance with each sheet material. For example, for the sheet material having a large heat capacity, in order to assure fixing performance of the toner (developer) to the sheet material, the conveying speed of the sheet material is reduced or a set value of a fixing temperature is increased. The transfer condition denotes, for example, a value of a high voltage (bias) which is applied to the secondary transfer roller 9. The fixing condition denotes, for example, a temperature of the fixing roller 14.

The user can set the type of sheet material through the host computer 300 or the operation panel unit 302. The image forming apparatus makes control to change the image forming conditions such as transfer condition, fixing condition, and conveying speed according to the sheet type set by the user as mentioned above. The print mode for setting the image forming conditions based on the sheet type designated by the user (pre-designated sheet type) as mentioned above is called a designating mode (second mode).

An automatic mode (first mode) in which the sheet type is automatically discriminated by the sheet material discriminating apparatus 41, which will be described hereinafter and the image forming conditions based on a detection result by the sheet material discriminating apparatus 41 are set is also prepared. TABLE 1 shows a list of print modes (designating mode/automatic mode).

A surfaceness and a basis weight of the target sheet material of every designating mode are shown in TABLE 1. The surfaceness denotes a concave/convex state of the surface of the sheet material. In TABLE 1, there are relations of a concave/convex state C>a concave/convex state A>a concave/convex state B. This means that a degree of the concave/convex state C is large (a depth of concave/convex is large) and a degree of the concave/convex state decreases in order of the states B, A and C. As a basis weight, the sheet materials whose basis weights are larger in a thick paper mode and an envelope mode than that in a plain paper mode are used as targets. "All" shown in TABLE 1 denotes that the sheet materials of all basis weights or surfaceness are used as targets. In the automatic mode, since the type of sheet material is automatically discriminated, "All" is shown as target sheet materials.

TABLE 1

| | Target sheet materials | |
|---|---|---|
| Print mode | Surfaceness of sheet material | Basis weight |
| Designating mode/ Plain paper mode | Plain paper (concave/convex state A) | <120 g/m$^2$ |
| Designating mode/ Thick paper mode | Plain paper (concave/convex state A) | ≧120 g/m$^2$ |
| Designating mode/ Glossy paper mode | Glossy paper (concave/convex state B) | All |
| Designating mode/ Glossy film mode | Glossy film (concave/convex state B) | All |
| Designating mode/ Envelope mode | Envelope (concave/convex state C) | ≧120 g/m$^2$ |
| Automatic mode | All | All |

<Sheet Material Discriminating Method Upon Setting of Automatic Mode>

Subsequently, a sheet material discriminating method upon setting of the automatic mode will be described with reference to FIGS. 4 to 7.

Figure 4:
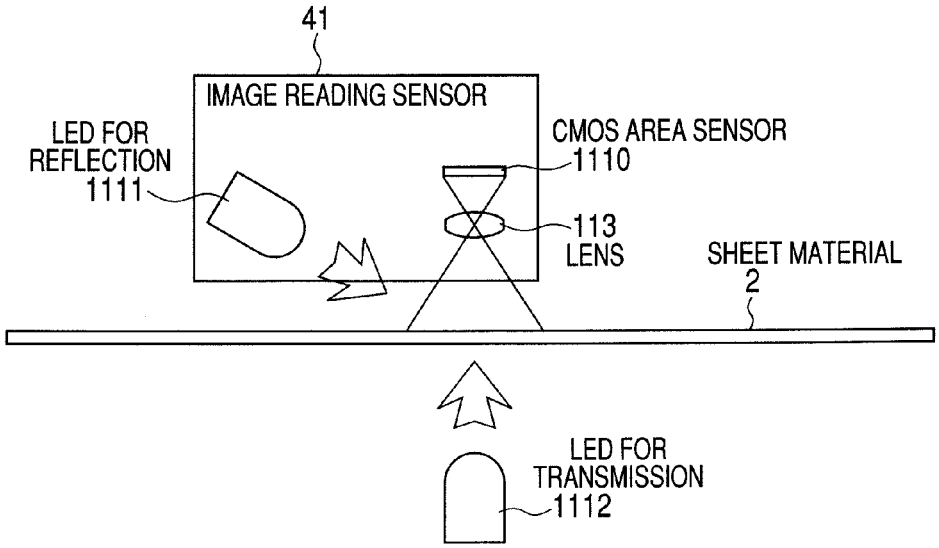
FIG. 4 is a schematic cross sectional view illustrating a schematic construction of an image reading sensor according to the embodiments 1 to 3.

FIG. 4 is a schematic cross sectional view illustrating a schematic construction of the sheet material discriminating apparatus 41 for detecting the surface smoothness and the reflection light amount or transmission light amount of the sheet material. An image reading sensor as a sheet material discriminating apparatus 41 (hereinbelow, referred to as an image reading sensor 41) is arranged at a position just after the registration sensor 19. The fed sheet material 2 is temporarily stopped after a predetermined time after it passed through the registration sensor 19. The sheet material type, that is, a type of sheet material 2 is discriminated by the following method.

As illustrated in FIG. 4, the image reading sensor 41 has: an LED 1111 for reflection (light irradiating unit); an LED 1112 for transmission (light irradiating unit) which is arranged on the side opposite to the sheet material 2 and is used to detect a transmitted light amount; a CMOS area sensor 1110 (imaging unit); and a lens 1113 serving as an image forming lens. Light emitted from the reflecting LED 1111 as a light source is irradiated to the surface of the sheet material 2. Reflection light emitted from the inside of an area of the sheet material 2 to which the light has been irradiated is converged through the lens 1113 and formed as an image onto the CMOS area sensor 1110. By this method, the surface video image (video image in the area to which the light has been irradiated) of the sheet material 2 is read out. The reflecting LED 1111 is arranged so as to irradiate the LED light onto the surface of the sheet material 2 obliquely at a predetermined angle as illustrated in FIG. 4.

Figure 5:
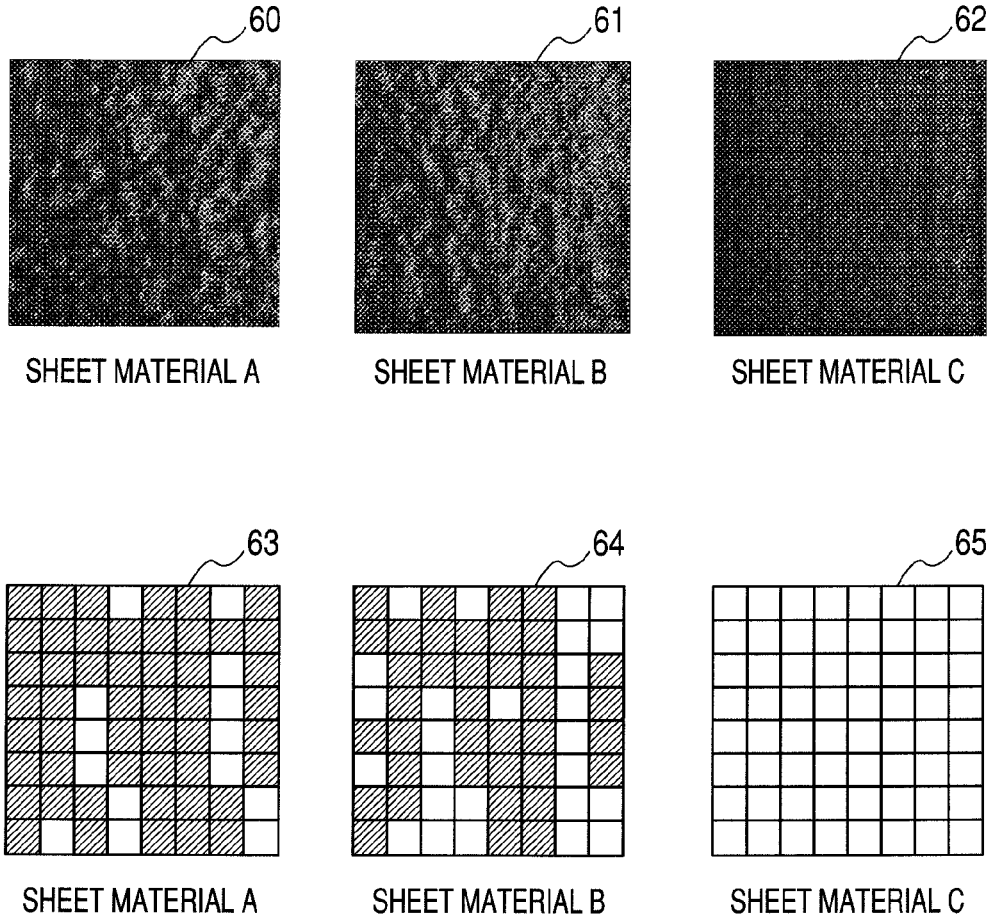
FIG. 5 is a diagram illustrating sheet material detection results of a reflecting LED of the image reading sensor according to the embodiments 1 to 3.

FIG. 5 is a diagram illustrating relations between the surface of the sheet material 2 which is read out by the CMOS area sensor 1110 of the image reading sensor 41 and examples of images obtained by digitally processing an output from the CMOS area sensor 1110 into (8×8) pixels. The digital process is executed by a method whereby the analog output from the CMOS area sensor 1110 is converted into pixel data of 8 bits by an A/D converter (not shown) as a converting unit.

In FIG. 5, an image 60 is a surface magnified image of a sheet material A of what is called rough paper in which the surfaceness of the sheet material A is relatively coarse and a degree of concave/convex portions due to the fiber of the sheet material A is large. An image 61 is a surface magnified image of a sheet material B of what is called plain paper which is ordinarily used in a general office. An image 62 is a surface magnified image of a sheet material C of glossy paper in which the fiber of the paper has sufficiently been compressed. The images 60 to 62 read out by the CMOS area sensor 1110 are digitally processed and become images 63 to 65 illustrated in FIG. 5. As mentioned above, the images on the surface differ depending on the type of sheet material. It is a phenomenon which occurs mainly because the states of the fiber in the paper surface differ. At this time, the reflection light amount of the sheet material 2 is detected from the sum or an average value of the light which entered the respective pixels. In this instance, only a result of one photosensing element may be used.

The image obtained by reading the surface of the sheet material 2 by the CMOS area sensor 1110 and digitally processing as mentioned above can be discriminated based on the surface state of the paper fiber of the sheet material 2 and the reflection light amount. In an image comparison arithmetic operation, a pixel Dmax of the maximum concentration and a pixel Dmin of the minimum concentration are derived from a result obtained by reading the images at a plurality of positions on the surface of the sheet material 2. The above processes are executed every read image and an averaging process is executed.

That is, when the paper fiber on the surface is rustling like a sheet material A, many fiber shadows Occur. Thus, since a difference of the fiber shadows between the bright portion and the dark portion becomes large, a value of (Dmax−Dmin) is large. On the surface like a sheet material C, an amount of fiber shadows is small and the value of (Dmax−Dmin) is small. The surface roughness of the sheet material is discriminated based on a comparison result. In the embodiment, the glossy film, glossy paper, and plain paper can be discriminated based on a detection result of (Dmax−Dmin) and the surfaceness of the sheet material can be detected.

Subsequently, a transmittance measuring method of the sheet material will be described. The light emitted from the transmitting LED 1112 as a light source is irradiated to the sheet material 2, that is, to the reading area of the image reading sensor 41 on the sheet material 2 from the side opposite to the image reading sensor 41.

Figure 6:
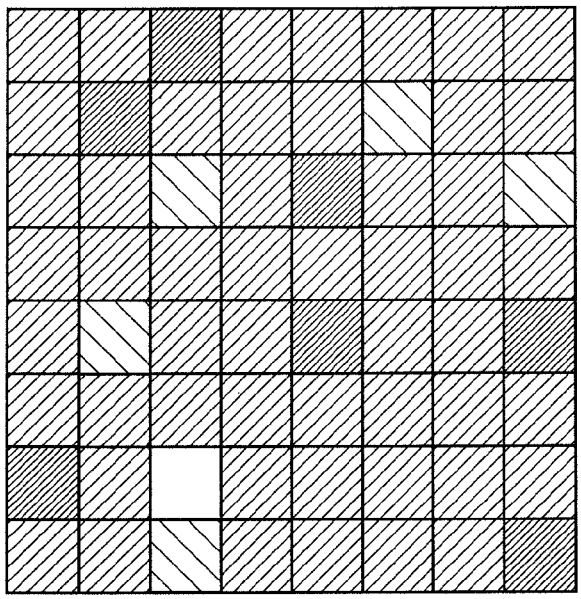
FIG. 6 is a diagram illustrating sheet material detection results of a transmitting LED of the image reading sensor according to the embodiments 1 to 3.

FIG. 6 is a diagram illustrating the surface of the sheet material 2 which is read out by the CMOS area sensor 1110 of the sheet material discriminating apparatus 41 by using the transmitting LED 1112 and an example of an image obtained by digitally processing the output from the CMOS area sensor 1110 into (8×8) pixels. The transmitted light of the sheet material 2 is converged through the lens 1113 and irradiated onto the CMOS area sensor 1110. At this time, the transmission light amount is discriminated from a total value or an average value of the light which entered the pixels in the whole area or a predetermined range of the CMOS area sensor 1110. In this instance, a result of only one of a plurality of photosensing elements may be used.

Figure 7:
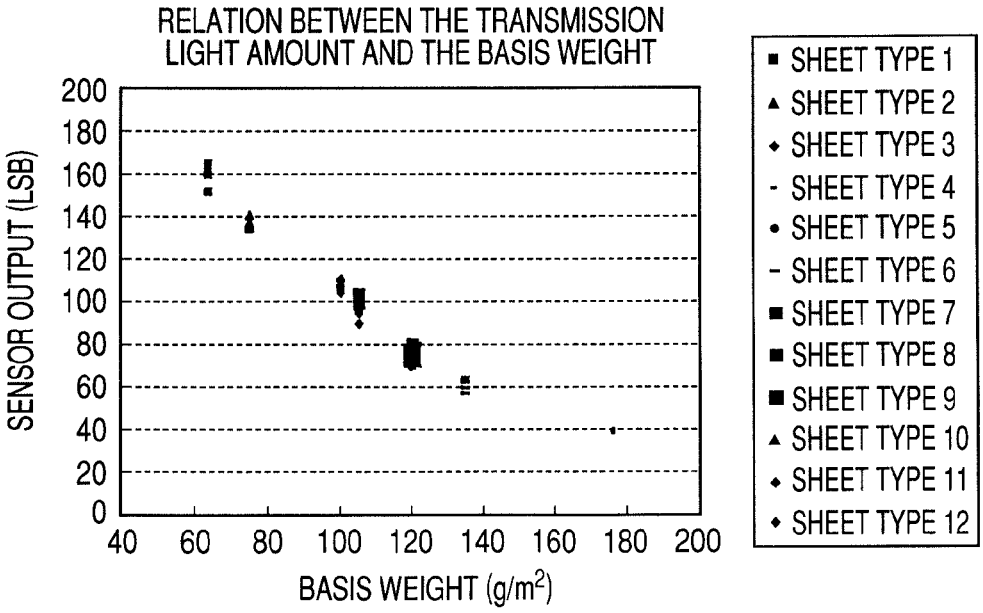
FIG. 7 is a diagram illustrating a relation between a transmission light amount of the transmitting LED of the image reading sensor and a basis weight according to the embodiments 1 to 3.

FIG. 7 is a diagram illustrating a relation between the basis weight and the transmission light amount of the sheet material 2. FIG. 7 is a graph in which the transmission light amounts are measured by the image reading sensor 41 with respect to twelve different types of sheet materials and their basis weights and sensor outputs (LSB) are plotted. For example, in the case of the sheet material having the large basis weight like thick paper, the transmission light amount is small. In the case of the sheet material having the small basis weight like thin paper, the transmission light amount is large. Therefore, a thickness of sheet material is discriminated from the transmission light amount. In the embodiment, the thickness of sheet material can be discriminated at the basis weight of about 120 g/m$^2$ as a threshold value. The sheet material 2 whose basis weight is equal to 120 g/m$^2$ or more is expressed as thick paper and the sheet material 2 whose basis weight is less than 120 g/m$^2$ is expressed as thin paper hereinbelow.

That is, the type of sheet material (surface roughness and thickness) can be discriminated by using the image reading sensor 41.

<Deciding Method of Image Forming Conditions in the Case where the Automatic Mode has been Set>

Subsequently, a deciding method of the image forming conditions in the case where the automatic mode has been set will be described.

Figure 8:
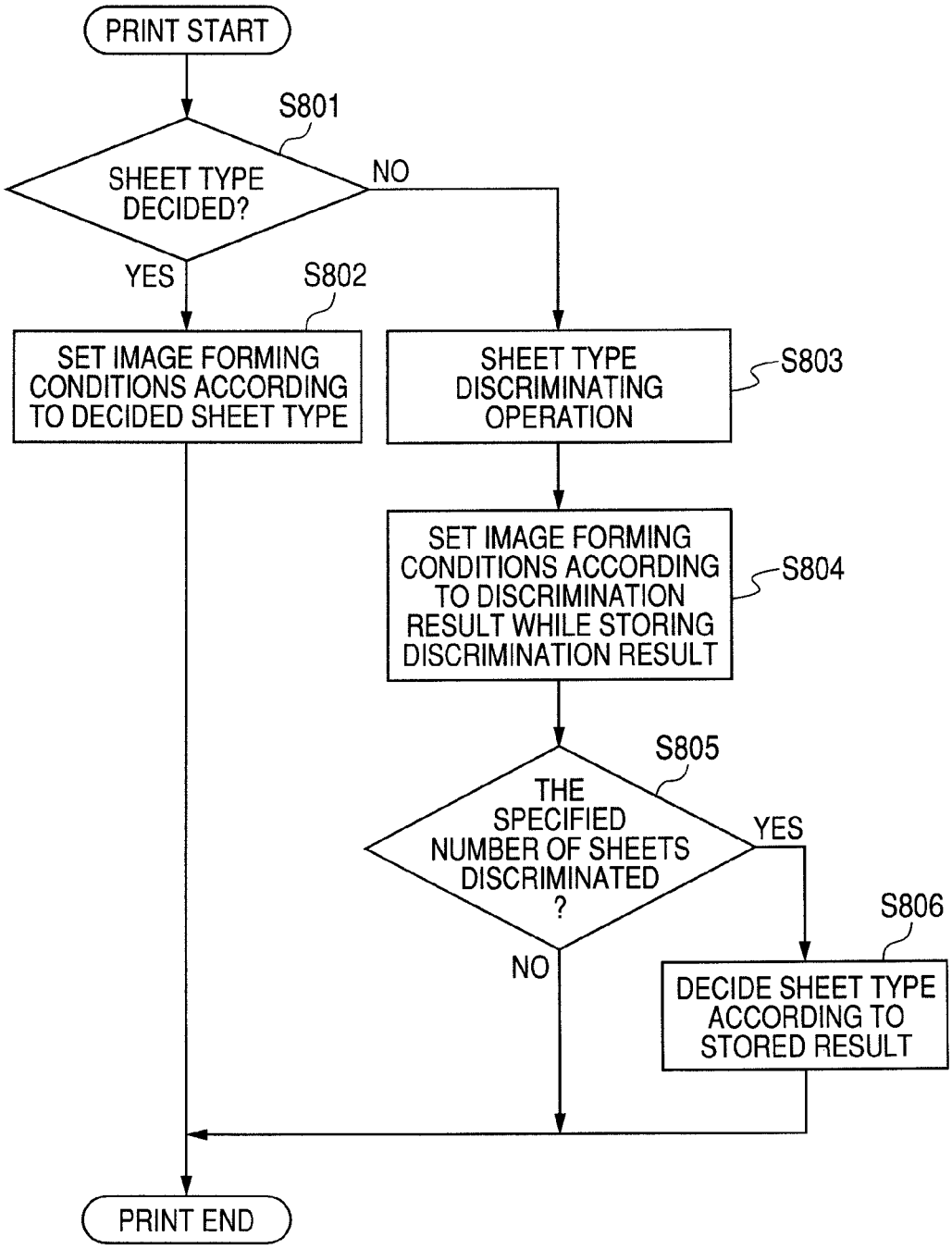
FIG. 8 is a flowchart for describing control for deciding image forming conditions according to the embodiments 1 to 3.

FIG. 8 is a flowchart for describing control which is made until the type of sheet material 2 fed from the sheet feed tray 1 is automatically detected by the image reading sensor 41 and the type of sheets stacked on the sheet feed tray 1 is decided. The processes shown in FIG. 8 are started when the printing operation in the image forming apparatus are started. For example, when the controller unit 301 receives a print job from the host computer 300 and the job is analyzed, the processes are started. When the processes are started (the printing operation is started), first, the CPU 305 of the engine control unit 303 (control unit) confirms that a decision value has been stored in a memory (storage unit) (not shown) as a sheet type discrimination result of the sheet feed tray 1 designated by the received job (step 801). If the decision value (decision result) of the sheet type discrimination result has been stored, the sheet type discriminating operation is not executed but the image forming conditions are determined by using the stored decision value of the sheet type discrimination result and the image forming conditions are set (step 802; hereinbelow, simply referred to as S802 or the like), and the processes are finished.

If the decision value of the sheet type discrimination result is not stored (NO in S801), the sheet type discriminating operation is executed (S803). The obtained result is stored, the image forming conditions are decided based on the obtained discrimination result, and the image forming conditions are set (S804). Subsequently, whether or not the discrimination results of the specified number of sheet materials have been stored is discriminated (S805). If the discrimination results have been stored, the discrimination results are determined (S806), the decision values are stored, and the processes are finished. If the discrimination results are not stored, the processes are finished. The type of sheet material decided in S806 is discriminated by checking whether or not the sheet type has been decided in S801 as a process which is executed when the next print job is received. The decided value (decision value) is used in S802.

The following describes the processes in which the discrimination results of the specified number of sheet materials are detected (the detection is made a plurality of number of times) and the type of sheet material is decided in the control flow shown in FIG. 8. In the image forming apparatus having a plurality of sheet feed ports, in the case where the foregoing control flow is applied, the discrimination is performed with respect to only a few sheets from the top one of the sheet materials stacked on each of the sheet feed trays and the decision value of each of the sheet type discrimination results is stored into the memory corresponding to each sheet feed tray. As a numerical value of a few sheets, in consideration of the variation of the discrimination results, the number of sheets enough to decide the type of sheets on the sheet feed tray is set to the specified number of sheets. In the normal case, the sheet type discrimination results of a few (the specified number of) sheets ought to become the same result or similar results. From the same detection result or a few (the specified number of) similar detection results, the discrimination result of the sheet materials stacked on the sheet feed tray is determined as a sheet type. When the sheet type is determined, the image forming conditions based on the decided sheet type as a discrimination result of the sheet material which is fed from the sheet feed tray which is decided after that are set and the printing is executed. Until the sheet type is determined, the sheet type discriminating operation is executed each time the sheet is fed. It is sufficient that the specified number of sheet materials to be detected is set to such a value that experiments are performed and the sheet type can be accurately detected and decided. It is sufficient that a value of the specified number of sheet materials is properly set according to the apparatus construction, the type of sheet material which is applied, or the like.

Figure 9A:
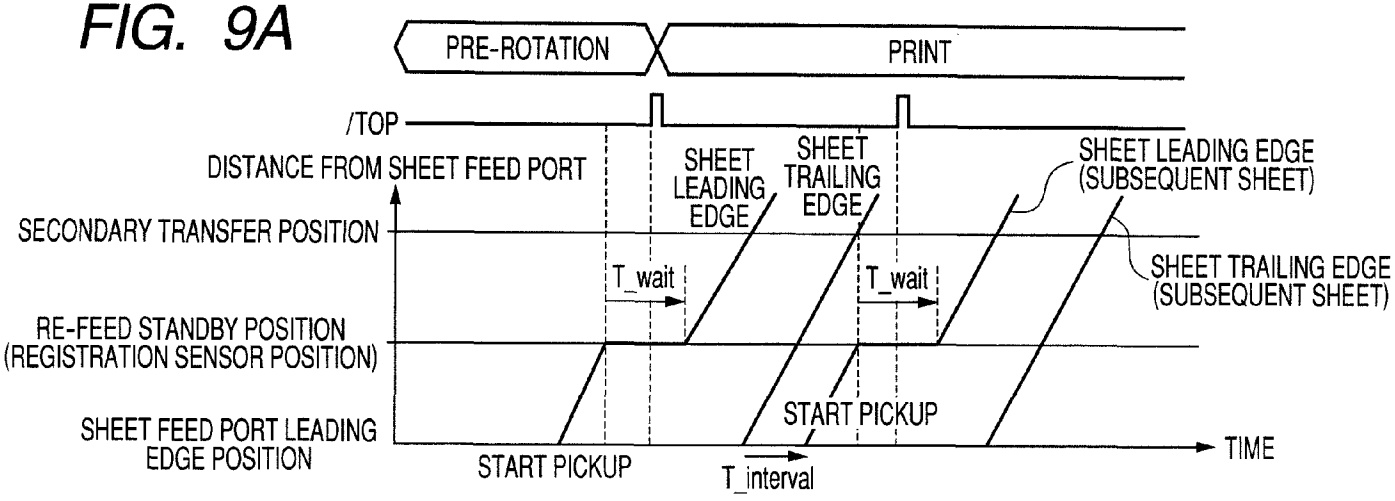

As mentioned above, when the automatic mode is set, until the sheet type of the sheet feed tray is determined, the process for discriminating the type of sheet material is executed to the specified number of fed sheet materials. With the reference to a diagram of FIG. 9A, the following describes the conveying operation of the sheet materials which is executed until the fed sheet materials reach the secondary transfer position in the case where the automatic mode has been designated. In FIG. 9A, an axis of abscissa indicates a time and an axis of ordinate indicates a distance from the sheet feed port. FIG. 9A is a graph illustrating a time-dependent change of a distance from the sheet feed port to each of a sheet material leading edge as a leading edge in the conveying direction of the target sheet material, a sheet material trailing edge thereof, a sheet material leading edge of a sheet material (subsequent sheet) subsequent to the target sheet material, and a sheet material trailing edge thereof. A time-dependent change of the /TOP signal and a state (pre-rotation state, printing state) of the image forming unit are shown in an upper portion of the graph. The pre-rotation denotes a process for activating various kinds of actuators such as a motor as a driving source for conveying the sheet material and the like and for activating various kinds of units for executing a charge, an exposure, a development, a transfer, and a fixing which are necessary for electrophotographic processes.

First, the leading edge of the sheet material 2 is located at the leading edge position of the sheet feed port. The sheet material 2 whose feeding operation has been started (hereinbelow, referred to as "start pickup") from the sheet feed tray 1 by the sheet feeding roller 39 passes through the registration sensor 19 and, thereafter, stops temporarily after the elapse of a predetermined time. The position where the sheet stops temporarily is assumed to be a re-feed standby position or a registration sensor position. The reason why the sheet is temporarily stopped is to detect the type of sheet material 2 by the image reading sensor 41, and a stop time of T_wait [sec] is necessary at this position. After the sheet material 2 was stopped for the time of T_wait [sec], it is fed and conveyed again to the secondary transfer position. Subsequently, after the trailing edge of the sheet material passed through the sheet feed port leading edge position of the sheet feed tray 1, the sheet feeding operation of the subsequent sheet material is started (start pickup) after the elapse of a predetermined time T_interval which has been set so as to minimize a sheet feeding interval (image forming interval) every sheet feed tray. That is, when the automatic mode is designated, since it is necessary to stop the sheet material in order to detect the sheet type until the sheet type is decided, the sheet feeding interval (image forming interval) increases. The sheet feeding interval corresponds to an interval between a plurality of sheet materials 2 in the case of continuously conveying the sheet material 2 and is also called a "sheet interval".

<Discrimination of Timing when the Sheet Type Discriminating Operation by Sheet Type Discriminating Operation Permitting Unit 313 can be Executed>

Subsequently, the following will describe the timing which is discriminated in the sheet type discriminating operation permitting unit 313 in the embodiment and when the sheet type discriminating operation can be executed without exerting an influence on the throughput.

Figure 9B:
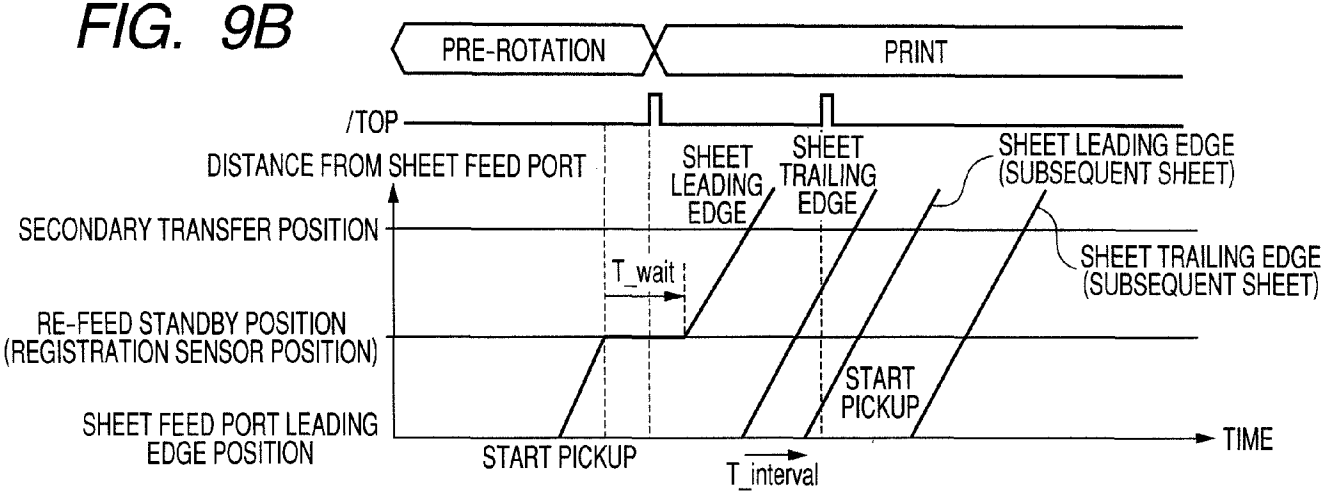

In a similar manner to FIG. 9A, FIG. 9B illustrates the conveying operation of the sheet material which is executed until the fed sheet material reaches the secondary transfer position in the case where the sheet type discriminating operation is executed to the first sheet material of the print job. In the case of executing the sheet type discriminating operation to the first sheet material of the print job, as illustrated in FIG. 9B, since a preparation (pre-rotation) for executing the image creation is performed for the time T_wait [sec] during which the sheet material is stopped at the position of the registration sensor, there is no influence that is exerted on the throughput. That is, in the case of executing the sheet type discriminating operation to the first sheet material of the print job, the sheet type discriminating operation can be executed without exerting an influence on the throughput. In other words, the sheet type discriminating operation permitting unit 313 determines that the first sheet material of the print job in which the image forming unit is in the pre-rotation state is at the timing when the sheet type discriminating operation can be executed.

<Deciding Method of Image Forming Conditions by Sheet Type Discrimination Control Unit 312>

Figures 10, 10A:
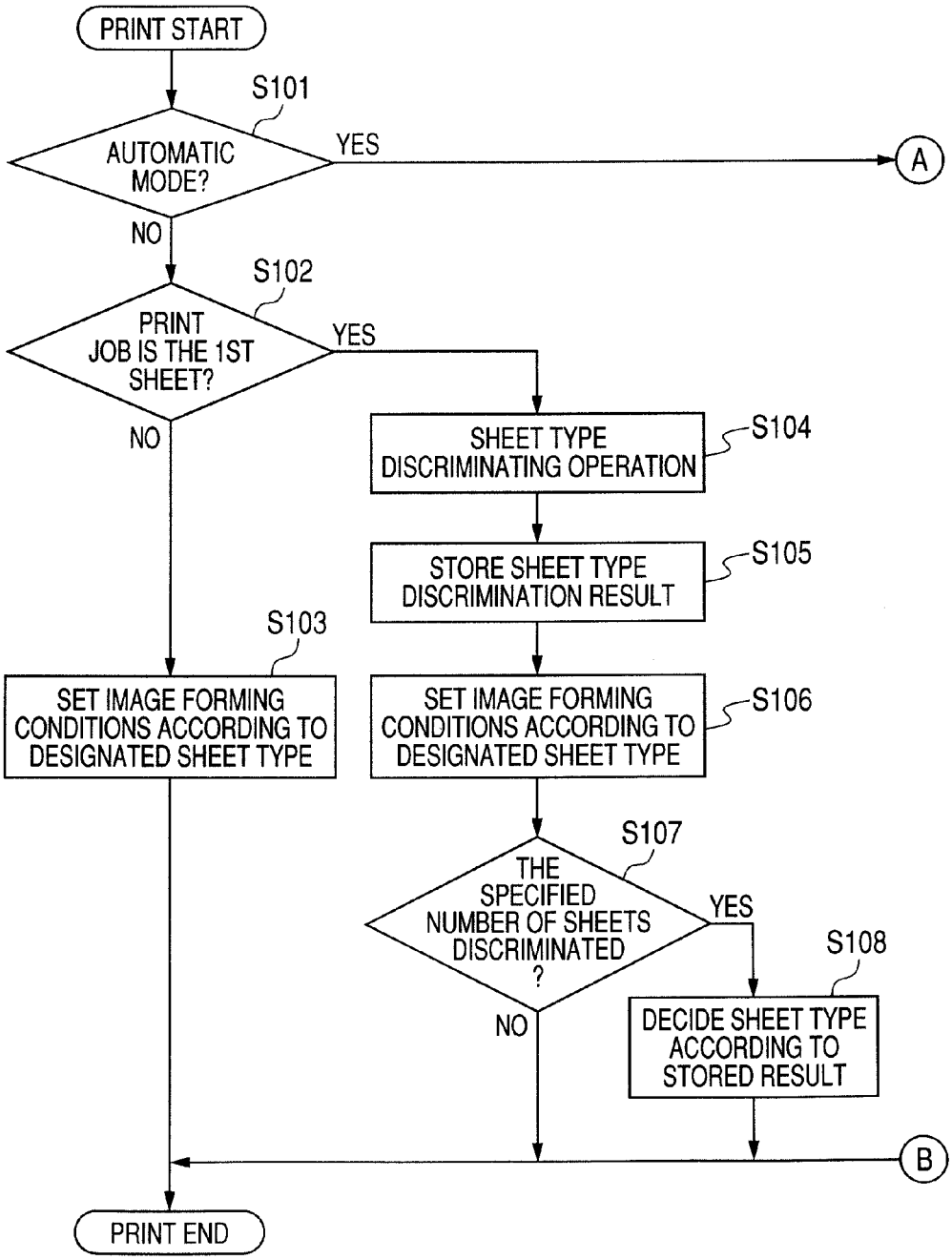
FIG. 10 is comprised of FIGS. 10A and 10B showing a flowchart for describing the control for deciding the image forming conditions according to the embodiment 1.
Figure 10B:
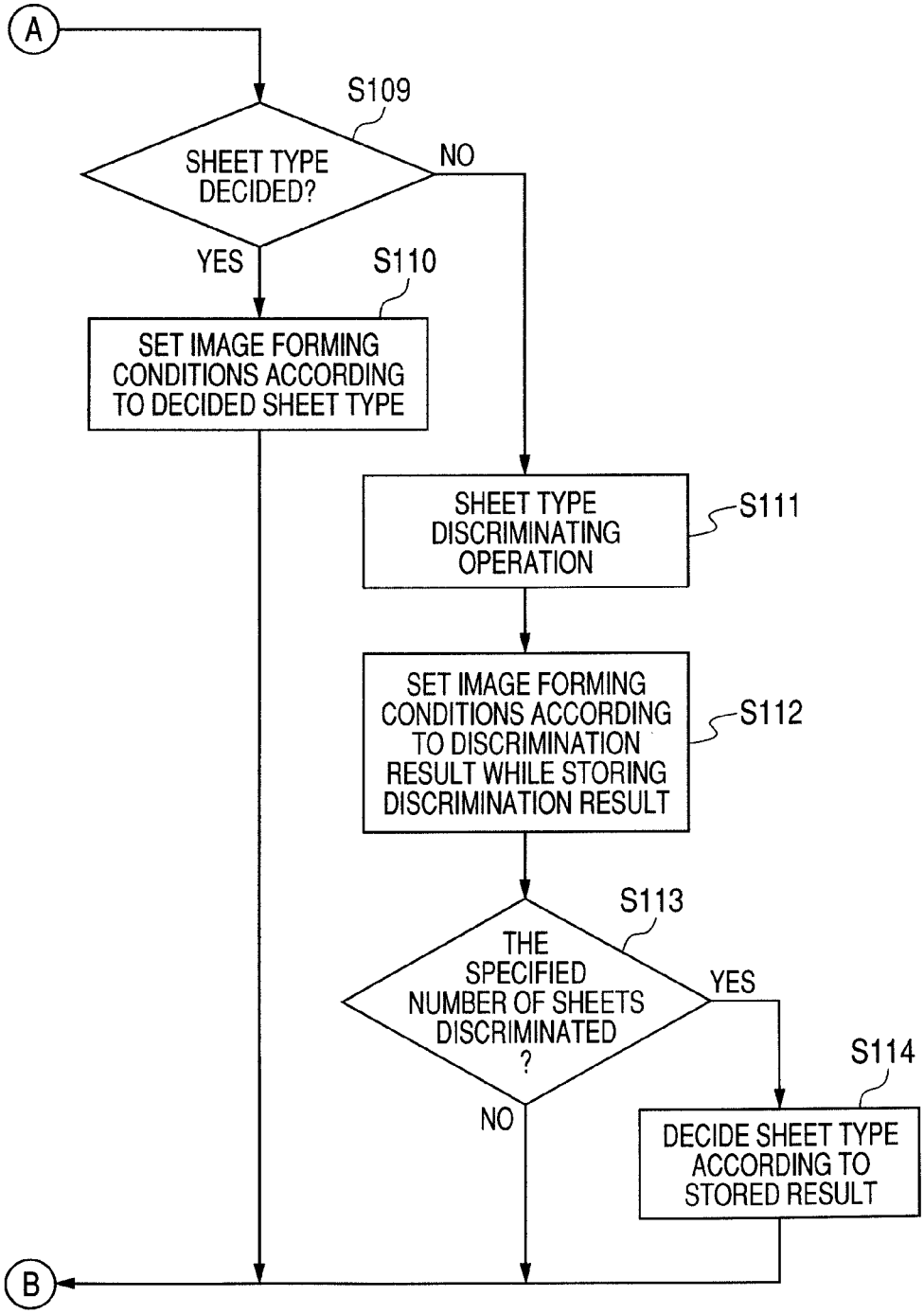

Subsequently, the following is a deciding method of the image forming conditions which are decided in the sheet type discrimination control unit 312 in the embodiment. FIG. 10 is comprised of FIGS. 10A and 10B showing a flowchart for describing the control in the case where the designating mode is set and the sheet type discriminating operation is executed to the first sheet material of the print job besides the case where the automatic mode has been designated. The processes shown in FIGS. 10A and 10B are started when the printing operation in the image forming apparatus is started. For example, when the controller unit 301 receives the print job and the job is analyzed, the processes are started. When the processes are started, first, the CPU 305 confirms a print mode designated by the received job (S101).

First, the case where the print mode is the designating mode will be described. When the designated print mode is the designating mode, to which designated number the sheet material during the printing corresponds is confirmed, specifically speaking, whether or not the sheet material is the first sheet material is discriminated (S102). If the sheet material during the printing is not the first sheet material in the print job, the sheet type discriminating operation is not executed but the sheet type discrimination control unit 312 sets the image forming conditions based on the sheet type designated by the user (S103) and the processes are finished. If the sheet material during the printing is the first sheet material in the print job, the sheet type discriminating operation is executed (S104). This is because, as already described above, when the sheet material is the first sheet material in the print job, it is determined by the sheet type discriminating operation permitting unit 313 that the first sheet material is at the timing when the sheet type discriminating operation can be executed. After that, a result obtained by the execution of the sheet type discriminating operation is stored (S105). The sheet type discrimination control unit 312 decides the image forming conditions based on the sheet type designated by the user (S106). Subsequently, whether or not the sheet material discrimination results of the specified number of sheet materials have been stored is discriminated (S107). If the discrimination results of the specified number of sheet materials have been stored, the discrimination results, that is, the sheet type is determined based on the stored results (S108), the decision value is stored, and the processes are finished. If the discrimination results of the specified number of sheet materials are not stored, the processes are finished.

Subsequently, the case where the designated print mode is the automatic mode will be described. If the designated print mode is the automatic mode (YES in S101), whether or not the decision value has been stored as a sheet type discrimination result of the designated sheet feed tray, that is, whether or not the sheet type has been determined is discriminated (S109). If the decision value of the sheet type discrimination result has been stored, that is, if the sheet type has been determined, the sheet type discriminating operation is not executed but the sheet type discrimination control unit 312 decides the image forming conditions by using the stored decision value of the sheet type discrimination result, that is, based on the decided sheet type and sets them (S110). After that, the processes are finished. If the decision value of the sheet type discrimination result is not stored, that is, if the sheet type is not determined (NO in S109), the sheet type discriminating operation is executed (S111). The obtained result is stored and the image forming conditions according to the obtained discrimination result are determined and set (S112). Subsequently, whether or not the discrimination results of the specified number of sheet materials have been stored is discriminated (S113). If the discrimination results of the specified number of sheet materials have been stored, the discrimination result, that is, the sheet type is determined according to the stored results (S114), the decision value is stored, and the processes are finished. If the discrimination results of the specified number of sheet materials are not stored in S113, the processes are finished.

The result decided in S108 or S114 is confirmed in S109 which is executed in the next print job. The decided value (decision value) is used in S110.

As mentioned above, according to the embodiment, it is determined that the case where the sheet type discrimination is made to the first sheet material (sheet material which was precedently fed during the pre-rotation) of the print job is a case where the sheet type can be discriminated without exerting an influence on the throughput. Further, by setting the designating mode and executing the sheet type discriminating operation to the first sheet material of the print job, the influence which is exercised on the throughput in the case where the automatic mode has been set can be reduced.

Embodiment 2

In the embodiment 1, in the sheet type discriminating operation permitting unit 313 for discriminating whether or not the sheet type discrimination can be executed without exerting an influence on the throughput, it is determined that the case where the sheet type discrimination is made to the first sheet material of the print job is the case where the sheet type discrimination can be executed without exerting an influence on the throughput. The following describes the method whereby in the sheet type discrimination control unit 312, by setting the designating mode and executing the sheet type discriminating operation to the first sheet material of the print job, the influence which is exercised on the throughput in the case where the automatic mode has been set is reduced.

Since the control regarding the sheet type discriminating operation permitting unit 313 in the embodiment 1 and the control regarding the sheet type discrimination control unit 312 in the embodiment 1 are different, a difference between them will be described in the embodiment 2. Since the component elements illustrated in FIGS. 1 to 8 are similar to those in the embodiment 1, they are designated by the same reference numerals and will be described. Also in this embodiment, it is assumed that the sheet type discrimination is made to the first sheet material of the print job in the designating mode.

<Discrimination about Timing when the Sheet Type Discriminating Operation by the Sheet Type Discriminating Operation Permitting Unit 313 can be Executed>

First, the following describes the timing when the sheet type discriminating operation can be executed without exerting an influence on the throughput which is discriminated in the sheet type discriminating operation permitting unit 313 in the embodiment.

(With Respect to Throughput-Down Control Regarding the Fixing Roller 14)

In the image forming apparatus, there is throughput-down control for suppression of temperature over-rising of the fixing unit 13.

Figure 11:
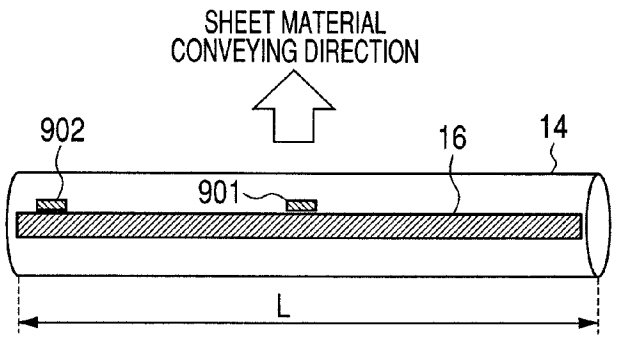
FIG. 11 is a schematic cross sectional view illustrating a construction of a fixing unit of an image forming apparatus according to the embodiment 2.

FIG. 11 is a schematic cross sectional view of the fixing roller 14 when seen from the conveying direction of the sheet material. A main thermistor 901 for detecting a temperature of a center portion of the roller and a sub-thermistor 902 for detecting a temperature of an edge portion of the roller are provided in the fixing roller. As for the heater 16 for heating the fixing roller 14, when the sheet material passes through the fixing roller 14, heat control is made over the whole width of the fixing roller 14 while feeding back the temperature detected by the main thermistor 901.

In the case of printing the sheet material whose width (length in the direction perpendicular to the conveying direction of the sheet material) is smaller than a width L of the fixing roller 14, the sheet material passes through the center portion of the fixing roller but does not pass through a portion near the edge portion of the fixing roller 14. However, since the heat control of the heater 16 is made based on the temperature of the center portion detected by the main thermistor 901, in the edge portion of the fixing roller 14, the heat capacity is not transferred to the sheet material but there is a case where the temperature rises extremely. If the temperature of the edge portion rose, in the case where the sheet material of a wide width is subsequently conveyed and fixed, there is a possibility of occurrence of a defective image. Therefore, in order to prevent such an extreme temperature over-rising of the edge portion, the engine control unit 303 makes the throughput-down control.

The throughput-down control is made to suppress the occurrence of a deviation in temperature control at the time of passage of the sheet material by reducing the number of sheet materials which pass through the fixing unit 13 per unit time by widening the image forming time interval step by step according to the temperature detected by the sub-thermistor 902. As shown in TABLE 2, an image interval at this time is calculated by discriminating a throughput-down level from the detection temperature of the sub-thermistor 902 and adding a corresponding throughput-down offset time [msec] to an ordinary sheet feeding interval (image forming interval). TABLE 2 shows a discrimination table of the throughput-down level according to the embodiment. The throughput-down offset time is time information for controlling the sheet feeding interval (image forming interval).

TABLE 2

| Detection temperature of sub-thermistor | Throughput-down level | Throughput-down offset time |
|---|---|---|
| Detection temperature < T0 | 0 | 0 |
| T0 ≦ Detection temperature < T1 | 1 | +1000 |
| T1 ≦ Detection temperature < T2 | 2 | +3000 |
| T2 ≦ Detection temperature < T3 | 3 | +5000 |
| T3 ≦ Detection temperature | 4 | +10000 |

(With Respect to Sheet Type Discriminating Operation Upon Throughput-Down Control)

Figure 12A:
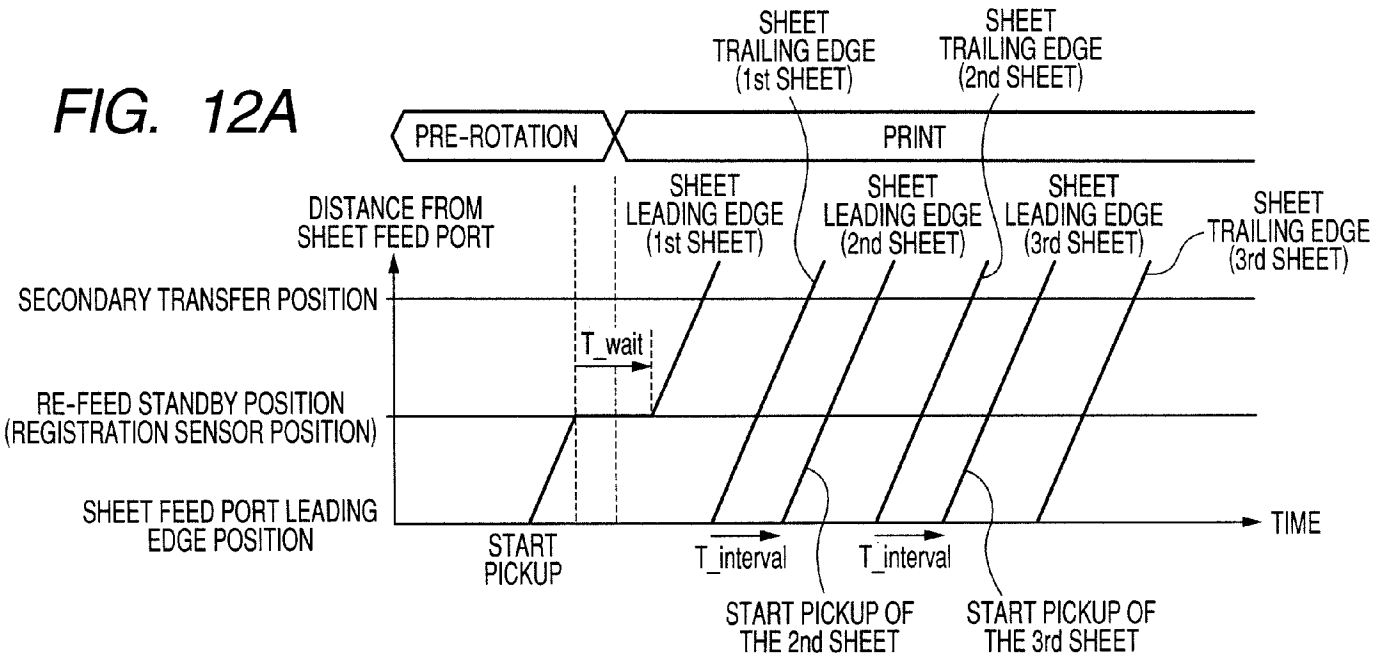
Figure 12B:
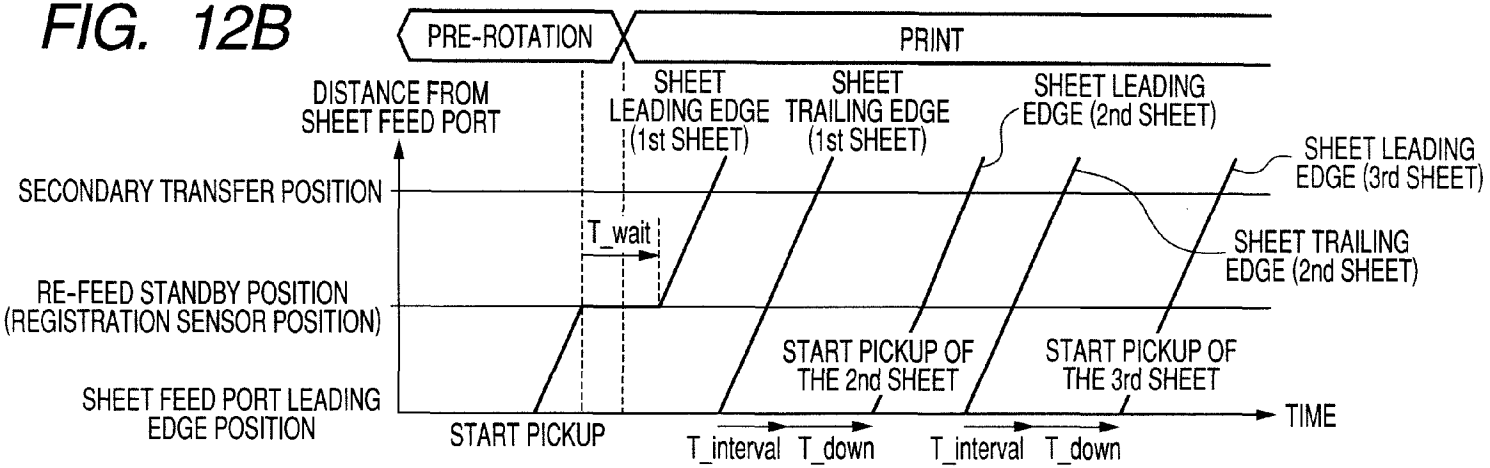
Figure 12C:
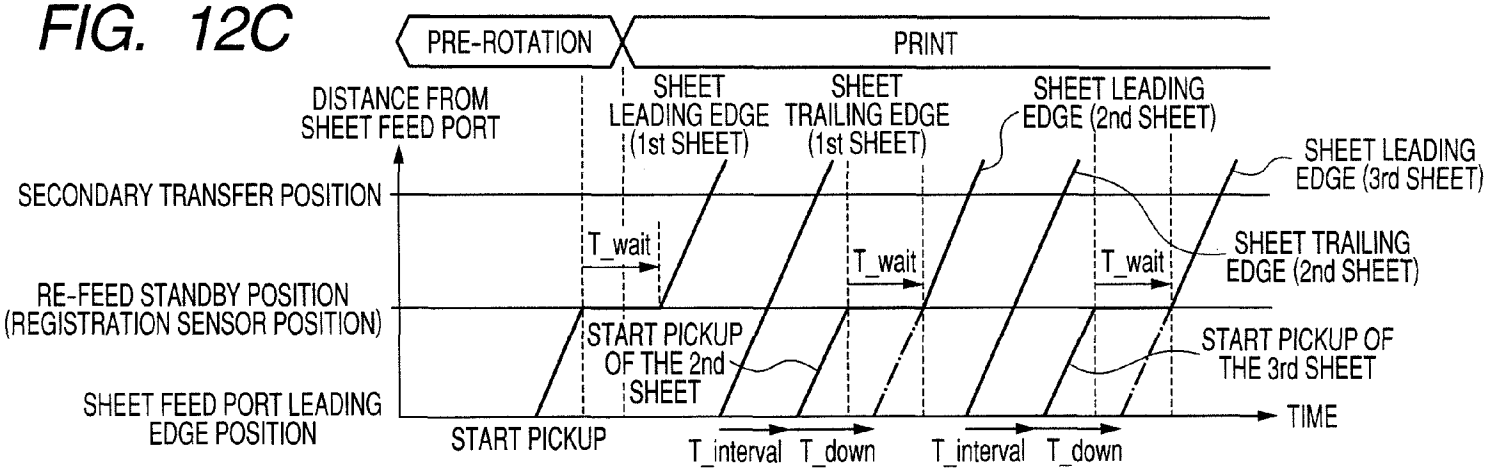

Subsequently, in a similar manner of FIGS. 9A and 9B shown in the embodiment 1, FIGS. 12A to 12C show the conveying operation of the sheet material which is executed until the fed sheet material in the case where the throughput-down control has been applied reaches the secondary transfer position. FIG. 12A illustrates the conveying operation of the sheet material in the case where the throughput-down control is not applied. FIGS. 12B and 12C illustrate the conveying operation of the sheet material in the case where the throughput-down control has been applied. In any of FIGS. 12A to 12C, as already mentioned in the embodiment 1, when the image forming unit is in the pre-rotation state, the first sheet material of the print job is precedently fed and the sheet type discriminating operation is executed. The sheet feeding interval (image forming interval) illustrated in FIG. 12A is the predetermined time T_interval which has been set so as to minimize the image interval every sheet feed tray 1. The sheet feeding interval (image forming interval) illustrated in FIG. 12B is the time in which the predetermined time T_down which is decided at the throughput-down level shown in TABLE 2 has been offset to the predetermined time T_interval which was set so as to minimize the image interval every sheet feed tray.

An example in which the sheet type discriminating operation is executed in the case where the throughput-down control has been applied will be described here with reference to FIG. 12C. In the case of executing the sheet type discriminating operation, after the leading edge of the sheet material fed by "start pickup" passed through the registration sensor 19, it is necessary to stop the sheet material for the predetermined time T_wait for detecting the type of sheet material by the image reading sensor 41 (time that is required for the detection by the sheet type detecting unit). If the throughput-down control is not applied, such a stop time becomes a cause for deterioration in throughput. However, the sheet feeding interval (image forming interval) in the case where the throughput-down control has been applied is equal to the time in which the predetermined time T_down that is decided at the throughput-down level has been added to the predetermined time T_interval which was set so as to minimize the sheet feeding interval (image forming interval) every sheet feed tray. Therefore, when T_down that is decided at the throughput-down level is longer than the time T_wait necessary to execute the sheet type discriminating operation, even if the sheet material is precedently fed and the sheet type discriminating operation is executed, there is no influence that is exerted on the throughput. That is, if the throughput-down control is applied and the predetermined time T_down that is decided at the throughput-down level is longer than the time T_wait necessary to execute the sheet type discriminating operation, the sheet type discriminating operation can be executed without exercising an influence on the throughput. In other words, when the throughput-down control is applied and T_down>T_wait, the sheet type discriminating operation permitting unit 313 determines that the apparatus is at the timing when the sheet type discriminating operation can be executed.

<Deciding Method of Image Forming Conditions by Sheet Type Discrimination Control Unit 312>

Figures 13, 13A:
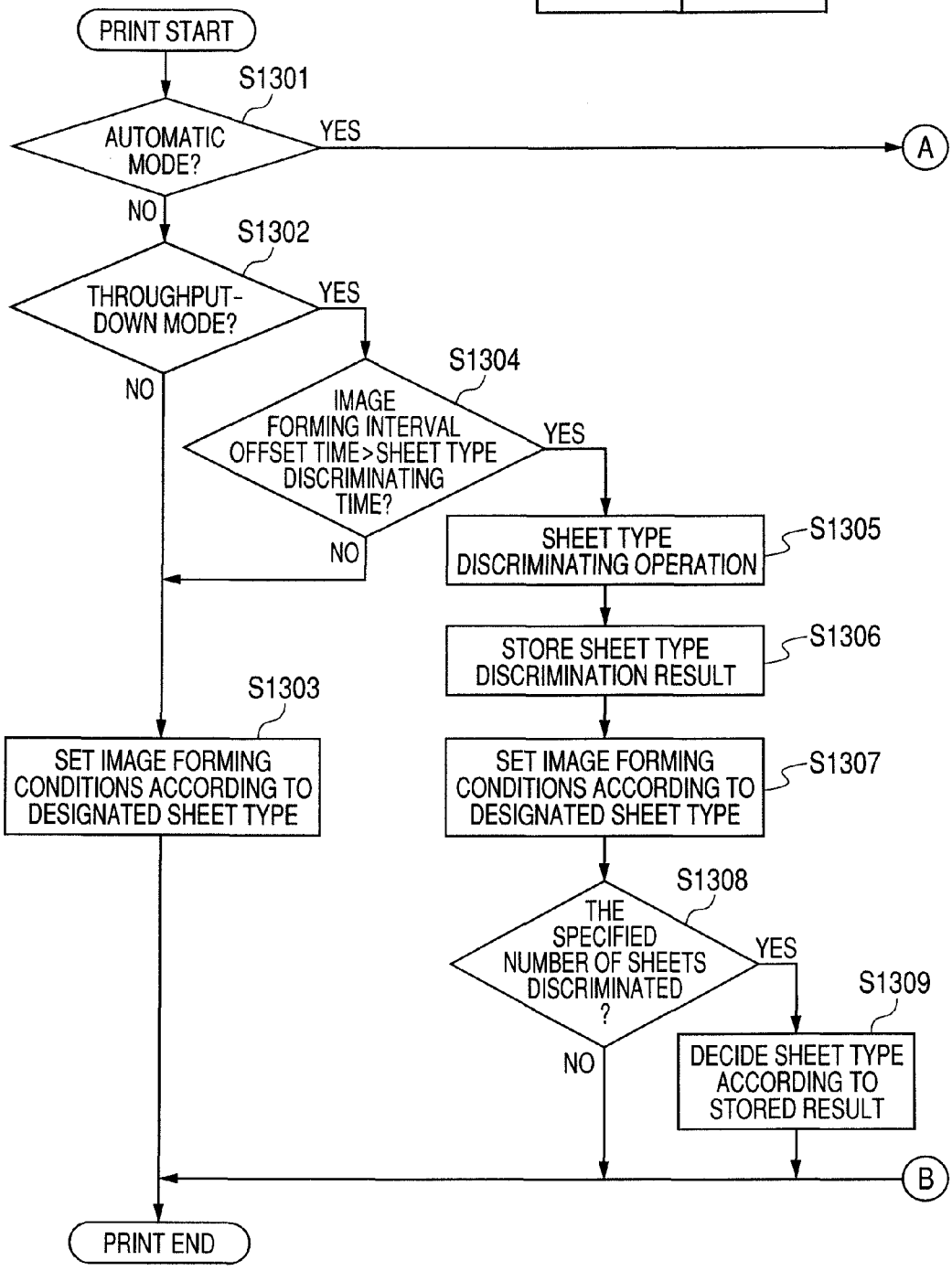
FIG. 13 is comprised of FIGS. 13A and 13B showing a flowchart for describing control for deciding image forming conditions according to the embodiment 2.
Figure 13B:
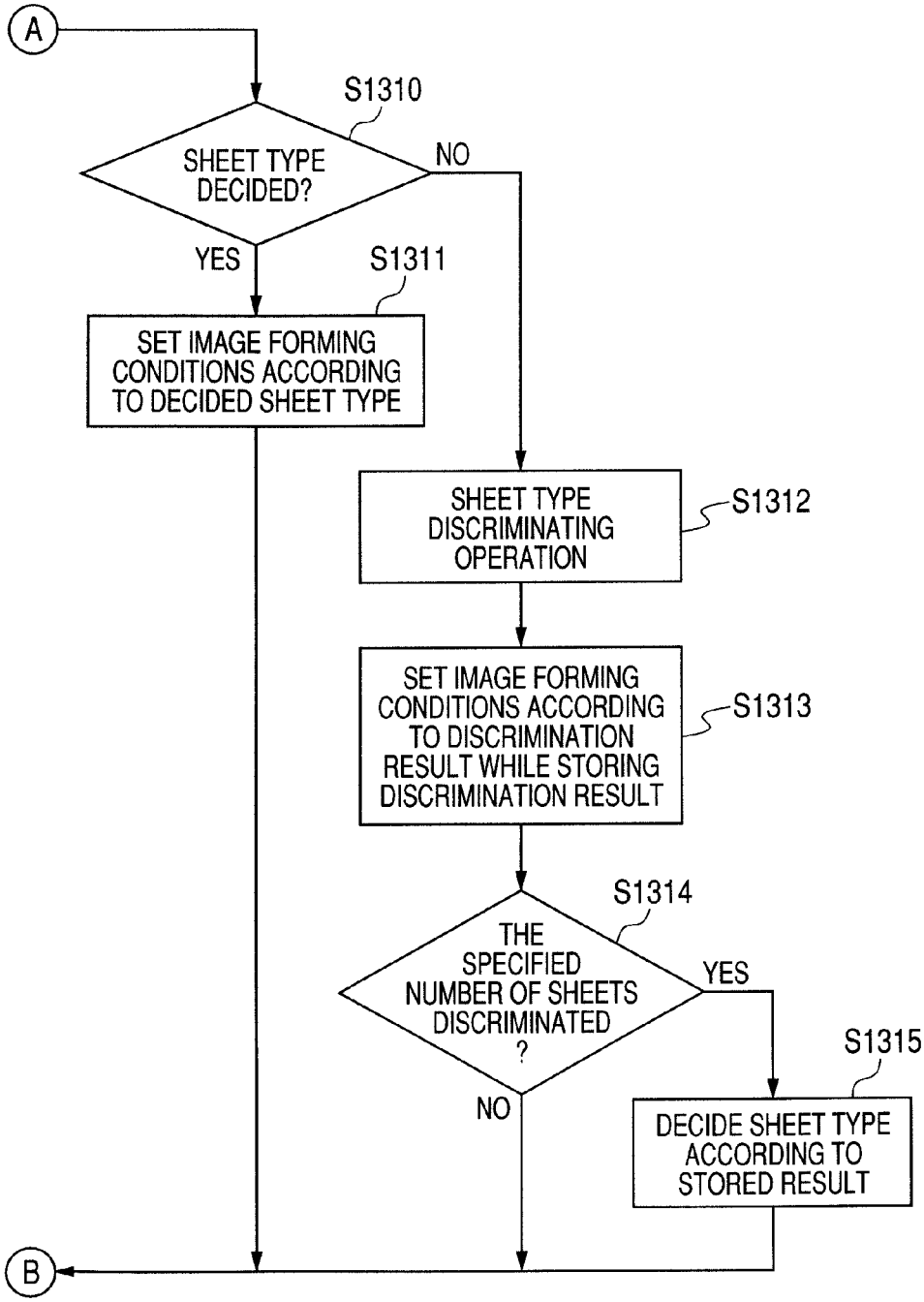

Subsequently, a deciding method of the image forming conditions which are decided in the sheet type discrimination control unit 312 in the embodiment will be described. FIG. 13 is comprised of FIGS. 13A and 13B shoeing a flowchart for describing the control in the case where the designating mode is set and the sheet type discriminating operation is executed to the sheet material to which the throughput-down control has been applied besides the case where the automatic mode has been designated. The processes shown in FIGS. 13A and 13B are started when the printing operation in the image forming apparatus is started. For example, when the controller unit 301 receives the print job and the job is analyzed, the processes are started. When the processes are started, first, the CPU 305 confirms the print mode designated by the received job, specifically speaking, discriminates whether or not the print mode is the automatic mode (S1301). First, the case where the print mode is the designating mode will be described. When the designated print mode is the designating mode, whether or not the image forming apparatus is in the state where the throughput-down control for suppressing the temperature over-rising of the fixing unit 13 has been applied (hereinbelow, referred to as a throughput-down mode) is discriminated (S1302).

When the image forming apparatus is in the throughput-down mode, the following processes are executed. That is, whether or not the image forming interval offset time (T_down) which is decided based on the throughput-down level (refer to TABLE 2) that is determined from the detection temperature of the sub-thermistor 902 is longer than the time (T_wait) necessary for the sheet type discriminating operation (S1304). When the image forming interval offset time is longer than the time necessary for the sheet type discriminating operation, the sheet type discriminating operation is executed (S1305). An obtained result is stored (S1306). The image forming conditions based on the sheet type designated by the user are decided (S1307). Subsequently, whether or not the sheet material discrimination results of the specified number of sheet materials have been obtained and stored is discriminated (S1308). If the discrimination results of the specified number of sheet materials have been stored, the sheet type is determined based on the discrimination results (S1309), the decision value is stored, and the processes are finished. If the discrimination results of the specified number of sheet materials are not obtained and are not stored in S1308, the processes are finished.

If the image forming interval offset time is equal to or shorter than the time necessary for the sheet type discriminating operation (NO in S1304) and if the image forming apparatus is not in the throughput-down mode (NO in S1302), the sheet type discriminating operation is not executed. In this case, the image forming conditions based on the sheet type designated by the user are set (S1303) and the processes are finished.

When the designated print mode is the automatic mode (YES in S1301), processes similar to those in S109 to S114 in FIG. 10B in the embodiment 1 are executed. A result decided in one of S1309 and S1315 is confirmed in S1310 which is executed in the next print job and the decided value (decision value) is used in S1311.

As described above, according to the embodiment, it is determined that the case of discriminating the sheet type of the sheet material in which the throughput-down control for suppression of the temperature over-rising of the fixing unit 13 is made is the case where the sheet type discrimination can be made without exerting an influence on the throughput. By executing the sheet type discrimination even in the case where the designating mode is set and the image forming apparatus is making the throughput-down control, the influence which is exercised on the throughput in the case where the automatic mode has been set can be reduced.

Embodiment 3

In the embodiment 1, in the sheet type discriminating operation permitting unit 313 for discriminating whether or not the sheet type discrimination can be executed without exerting an influence on the throughput, it is determined that the case where the sheet type discrimination is made to the first sheet material of the print job is the case where the sheet type discrimination can be executed without exerting an influence on the throughput. The embodiment also describes the method whereby in the sheet type discrimination control unit 312, by setting the designating mode and executing the sheet type discriminating operation to the first sheet material of the print job, the influence which is exercised on the throughput in the case where the automatic mode has been set is reduced.

In the embodiment 2, it is determined that the case of discriminating the sheet type of the sheet material in which the throughput-down control for suppression of the temperature over-rising of the fixing unit 13 is made is the case where the sheet type discrimination can be made without exerting an influence on the throughput. The embodiment 2 also describes the method whereby in the sheet type discrimination control unit 312, by executing the sheet type discrimination in the case where the designating mode is set and the image forming apparatus is making the throughput-down control, the influence which is exercised on the throughput in the case where the automatic mode has been set is reduced.

Since the control regarding the sheet type discriminating operation permitting unit 313 in the embodiments 1 and 2 and the control regarding the sheet type discrimination control unit 312 in the embodiments 1 and 2 are different, a difference between them will be described in the embodiment 3. Since the component elements illustrated in FIGS. 1 to 8 are similar to those in the embodiment 1, they are designated by the same reference numerals and will be described. Also in this embodiment, it is assumed that the sheet type discrimination is made to the first sheet material of the print job in the designating mode.

<Discrimination about Timing when the Sheet Type Discriminating Operation by the Sheet Type Discriminating Operation Permitting Unit 313 can be Executed>

First, the following is the timing when the sheet type discriminating operation can be executed without exerting an influence on the throughput which is discriminated in the sheet type discriminating operation permitting unit 313 in the embodiment.

(With Respect to Control for Delaying Post-Rotation in the Case where Print Start Command is Delayed)

Generally, the controller unit 301 receives the image information and the print command from the host computer 300, analyzes the received image information, converts into the bit data, and thereafter, transmits the print start command and the video signal to the engine control unit 303.

If the print reservation commands and the print start command of the (N+1)th sheet material have been received within a predetermined time T_best from the /TOP signal output of the Nth sheet material, the engine control unit 303 executes the image forming operation and the sheet feeding operation at the minimum image interval.

Figure 14A:
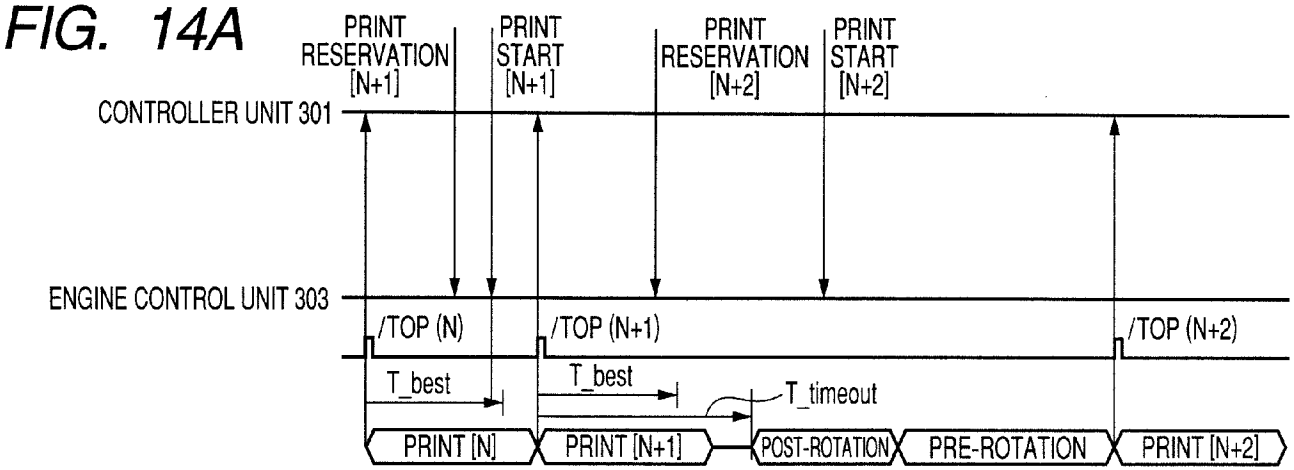
FIGS. 14A and 14B are timing charts of commands of an engine control unit and a controller unit according to the embodiment 3.

FIG. 14A is a timing chart illustrating the state (printing, post-rotation, etc.) of the image forming unit, the /TOP signal, and the transmission and reception of the signals between the controller unit 301 and the engine control unit 303. As illustrated in FIG. 14A, the engine control unit 303 outputs the /TOP signal of the (N+1)th sheet material and starts the image forming process (printing) of the (N+1)th sheet material. After that, if the print start command of the (N+2)th sheet material is not received from the controller unit 301 at a point of time after the elapse of a predetermined time T_timeout, the post-rotating operation is executed for a finishing process of the printing. If the print start command of the (N+2)th sheet material is received after the post-rotating operation was started, after completion of the post-rotating operation, the pre-rotating operation for preparation of image creation is executed again and the printing of the (N+2)th sheet material is executed. The post-rotation denotes a process for stopping the various kinds of actuators and units.

That is, in the controller unit 301, there is a case where it takes time for the processes to analyze the image information and convert into the bit data and the print start command of the (N+2)th sheet material cannot be transmitted to the engine control unit 303 within the predetermined time T_timeout from the /TOP signal of the (N+1)th sheet material. In this case, before all pages requested from the host computer 300 are printed, the post-rotating operation is temporarily executed, so that time-dependent performance until the job is completed deteriorates largely.

Figure 14B:
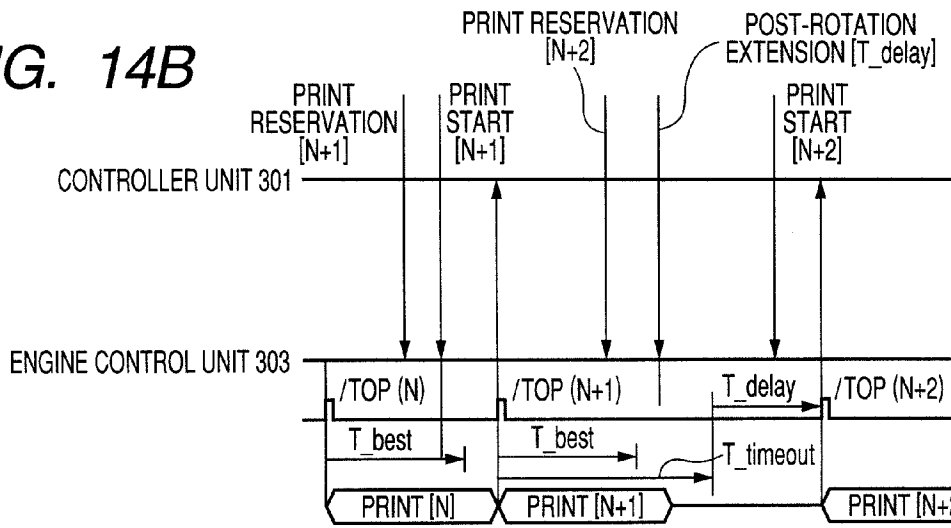

Therefore, as shown in the timing chart of FIG. 14B, although it has been determined that the printing of the (N+2)th sheet material is executed, if it is decided that the print start command of the (N+2)th sheet material cannot be transmitted within the predetermined time T_timeout, the controller unit 301 executes the following processes. That is, a command for delaying the timing when the image forming unit starts the post-rotation by T_delay (print delay time) is transmitted to the engine control unit 303. At this time, even after the elapse of the predetermined time T_timeout from the /TOP signal of the (N+1)th sheet material, the engine control unit 303 does not start the post-rotating operation until the elapse of the time T_delay but waits for the transmission of the print start command of the (N+2)th sheet material. If the print start command of the (N+2)th sheet material is received during such a period of time, the engine control unit 303 outputs the /TOP signal of the (N+2)th sheet material at a point of time when a predetermined time (T_timeout+T_delay) had elapsed from the /TOP signal of the (N+1)th sheet material, and executes the printing operation of the (N+2)th sheet material.

The command for delaying the timing when the image forming unit starts the post-rotation by T_delay as mentioned above is defined as, for example, "post-rotation extending command". Generally, there is a case where such a command is used in the case where it takes time for the processes to analyze the image information and convert into the bit data in the controller unit 301 or the like, thereby preventing the deterioration of the time-dependent performance until the completion of the job. The extending time T_delay until the start of the post-rotation in this instance is not limited to a fixed time but can be set to an arbitrary time by the controller unit 301 by a command system which has separately been defined.

Figure 15A:
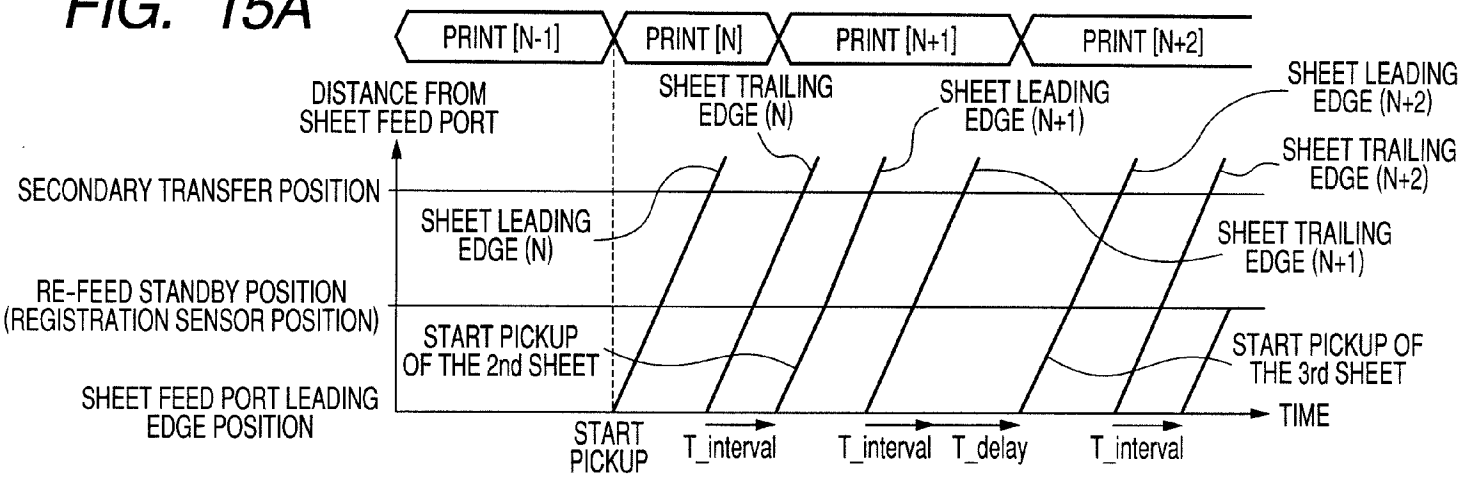
Figure 15B:
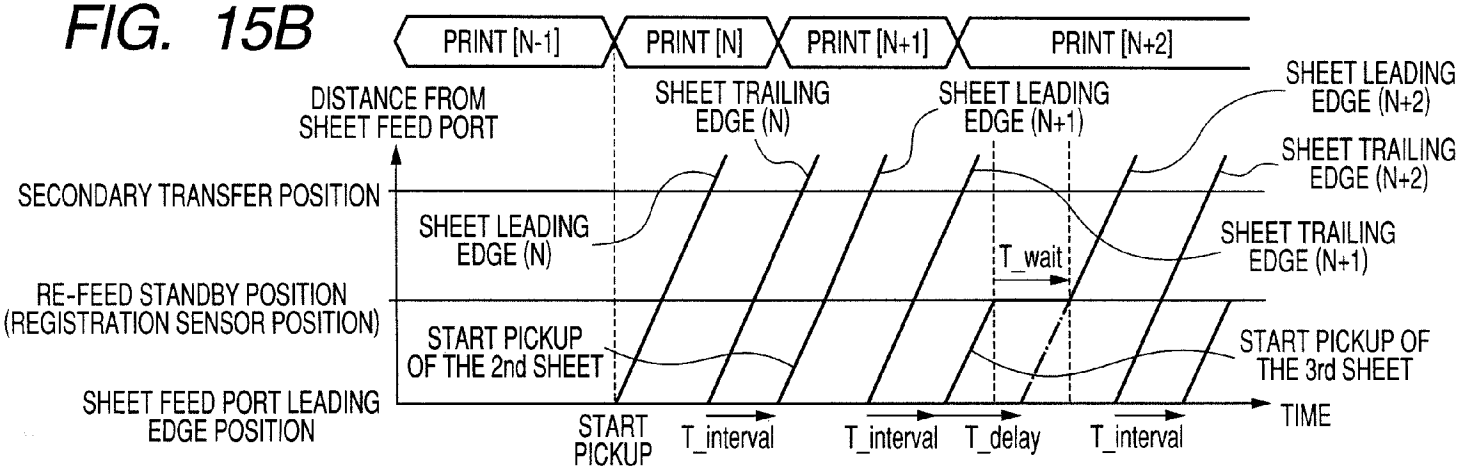

In a manner similar to FIGS. 9A and 9B and FIGS. 12A to 12C, diagrams of FIGS. 15A and 15B shows the conveying operation of the sheet material which is executed until the sheet material fed after the post-rotation extending command was received reaches the secondary transfer position. FIGS. 15A and 15B illustrate the state of the image forming unit of the (N−1)th and subsequent sheet materials after the print job was started. The sheet feed of the Nth and subsequent sheet materials is illustrated. Also in this case, it is assumed that when the image forming unit is in the pre-rotation state, the first sheet material of the print job is precedently fed and the sheet type discriminating operation is executed.

FIG. 15A illustrates the conveying operation of the sheet material in the case where the engine control unit 303 received the post-rotation extending command from the controller unit 301 during the execution of the print [N+1]. When the post-rotation extending command is received during the execution of the print [N+1], the image interval becomes as follows. That is, the image interval between the print [N+1] and the print [N+2] is equal to the time in which the extending time T_delay until the post-rotation start which is decided by the controller unit 301 has been added to the predetermined time T_interval which has been set so as to minimize the image interval every sheet feed tray.

With reference to FIG. 15B, the following describes an example in which the sheet type discriminating operation is executed to the fed sheet material after the post-rotation extending command was received. In the case of executing the sheet type discriminating operation, after the sheet material fed by "start pickup" passed through the registration sensor 19, it is necessary to stop the sheet material for the predetermined time T_wait (time necessary for the detection by the sheet type detecting unit) for detecting the type of sheet material by the image reading sensor 41. The image interval between the print [N+1] and the print [N+2] after the post-rotation extending command was received is equal to the time in which the extending time T_delay until the post-rotation start has been added to the predetermined time T_interval which has been set so as to minimize the image interval every sheet feed tray corresponding to the ordinary image interval. Therefore, when the extending time T_delay until the post-rotation start is longer than the time T_wait necessary to execute the sheet type discriminating operation, even if the sheet material was precedently fed and the sheet type discriminating operation was executed, there is no influence that is exerted on the throughput. That is, when the post-rotation extending command is received and the extending time T_delay until the post-rotation start which is decided by the controller unit 301 is longer than the time T_wait necessary to execute the sheet type discriminating operation, the sheet type discriminating operation can be executed without exerting an influence on the throughput. In other words, when the post-rotation extending command is received and T_delay>T_wait, the sheet type discriminating operation permitting unit 313 determines that the apparatus is at the timing when the sheet type discriminating operation can be executed.

<Deciding Method of Image Forming Conditions by Sheet Type Discrimination Control Unit 312>

Figures 16, 16A:
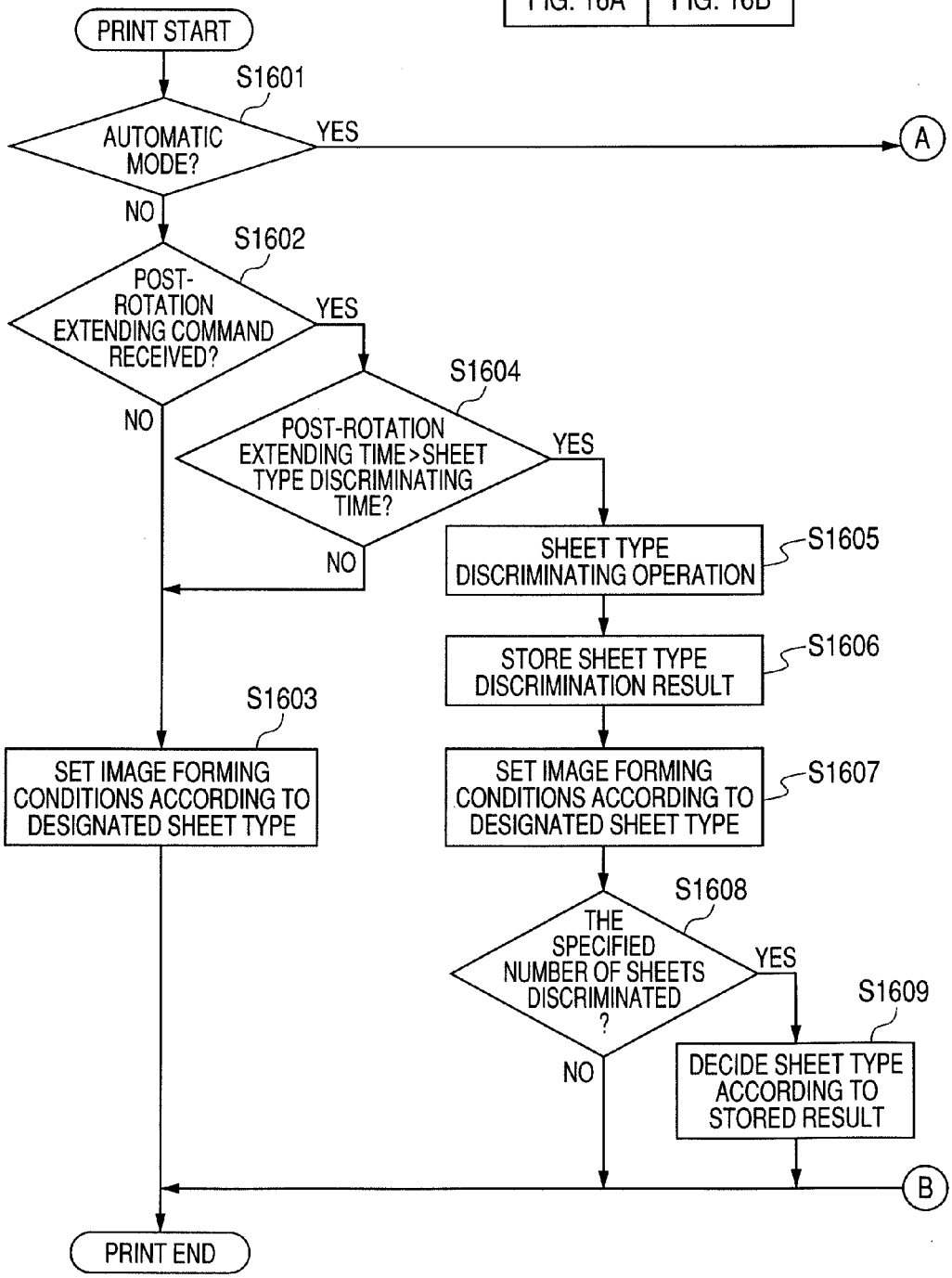
FIG. 16 is comprised of FIGS. 16A and 16B showing a flowchart for describing control for deciding image forming conditions according to the embodiment 3.
Figure 16B:
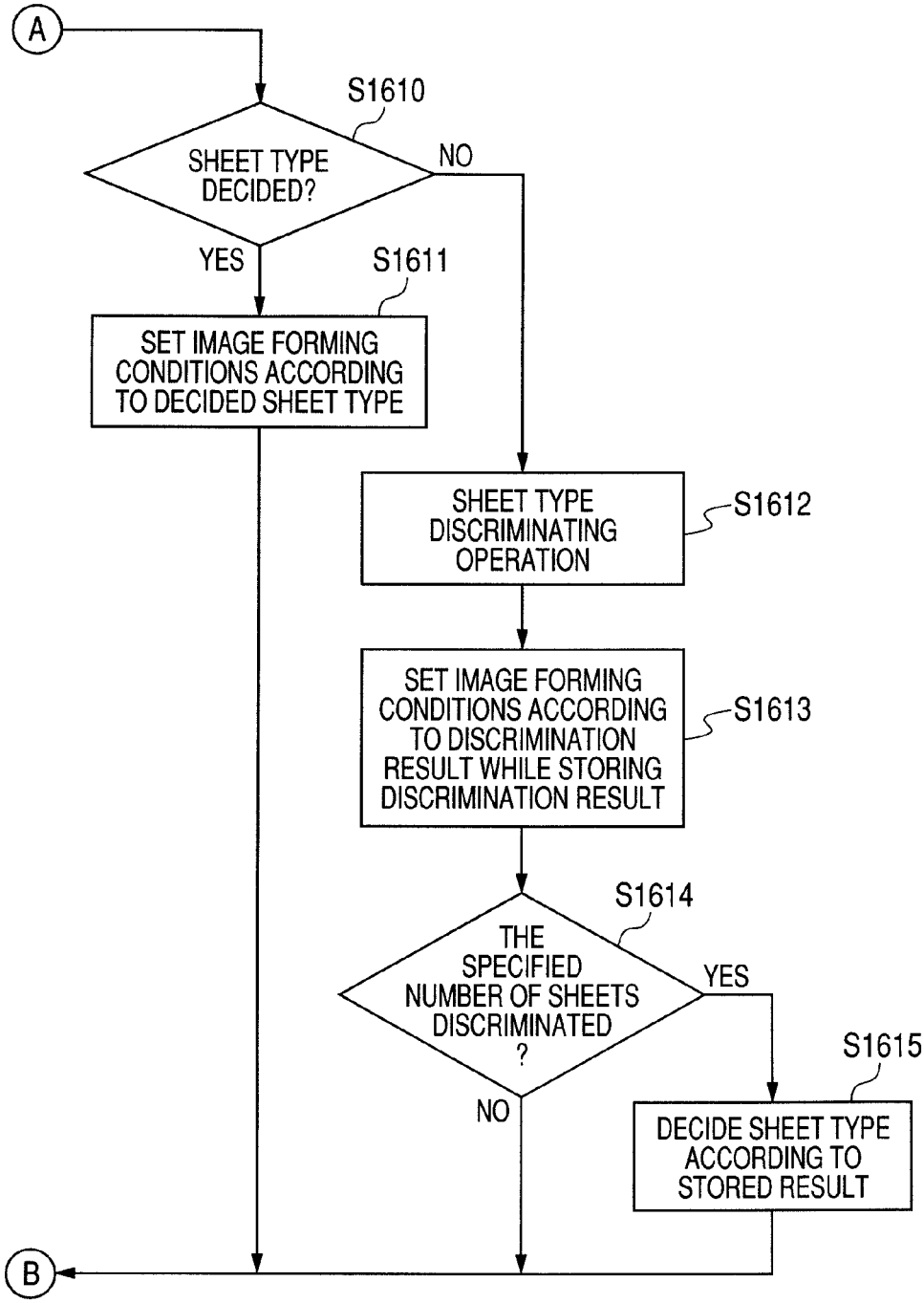

Subsequently, the following describes the deciding method of the image forming conditions which are decided in the sheet type discrimination control unit 312 in the embodiment. FIG. 16 is comprised of FIGS. 16A and 16B showing a flowchart for describing the control in the case where the designating mode is set and the sheet type discriminating operation is executed to the sheet material which is fed after the post-rotation extending command was received besides the case where the automatic mode has been designated. The processes shown in FIGS. 16A and 16B are started when the printing operation in the image forming apparatus is started. For example, when the controller unit 301 receives the print job and the job is analyzed, the processes are started. When the processes are started, first, the CPU 305 confirms the print mode designated by the received job, that is, discriminates whether or not the print mode is the automatic mode (S1601).

First, the case where the print mode is the designating mode will be described. When the designated print mode is the designating mode, whether or not the apparatus is at the timing just after the post-rotation extending command was received is discriminated (S1602). When the apparatus is at the timing just after the post-rotation extending command was received, whether or not the extending time T_delay until the post-rotation start which is decided by the controller unit 301 is longer than the time T_wait necessary to execute the sheet type discriminating operation is discriminated (S1604). If the extending time T_delay until the post-rotation start is longer than the time necessary to execute the sheet type discriminating operation, the sheet type discriminating operation is executed (S1605). The obtained result is stored (S1606). The image forming conditions based on the sheet type designated by the user are determined (S1607). Subsequently, whether or not the sheet material discrimination results of the specified number of sheet materials have been obtained and stored is discriminated (S1608). If the discrimination results of the specified number of sheet materials have been stored, the sheet type is determined based on the stored discrimination results (S1609), the decision value is stored, and the processes are finished. If the discrimination results of the specified number of sheet materials are not stored, the processes are finished.

If the extending time T_delay until the post-rotation start is shorter than the time necessary to execute the sheet type discriminating operation (NO in S1604) and when the post-rotation extending command is not received (NO in S1602), the sheet type discriminating operation is not executed. In this case, the image forming conditions based on the sheet type designated by the user are set (S1603) and the processes are finished.

Processes in the case where the designated print mode is the automatic mode are similar to those in S109 to S114 in FIG. 10B in the embodiment 1. The result decided in S1609 or S1615 is confirmed in S1610 of the next print job and the decided value (decision value) is used in S1611.

As described above, according to the embodiment, it is determined that the case where the sheet type discrimination is performed to the sheet material just after the post-rotation extending command was received is the case where the sheet type discrimination can be made without exerting an influence on the throughput. When the designating mode has been set and the post-rotation extending command has been received, by also executing the sheet type discrimination to the sheet material just after the post-rotation extending command was received, the influence that is exercised on the throughput in the case where the automatic mode has been set can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2008-091067, filed Mar. 31, 2008, and No.

2009-053706, filed Mar. 6, 2009, which are hereby incorporated by reference herein in their entirety.

What is claimed is:

1. An image forming apparatus having a first mode for forming an image based on a detected type of a recording medium and a second mode for forming the image based on a pre-designated type of recording medium, comprising:

a feeding unit which feeds the recording medium;

a detecting unit which detects the type of the recording medium which is fed; and an image forming unit which forms the image based on the type of the recording medium detected by the detecting unit or the pre-designated type of the recording medium, wherein in the second mode, the detecting unit detects the type of the recording medium which is fed by the feeding unit even if the type of recording medium is pre-designated, and in the first mode, the image forming unit forms the image based on a detection result of the detecting unit in the second mode.

2. An image forming apparatus according to claim 1, wherein the detecting unit detects the type of a specified number of recording medium.

3. An image forming apparatus according to claim 1, wherein in the second mode, the detecting unit detects the type of a first recording medium first fed by the feeding unit.

4. An image forming apparatus according to claim 1, further comprising an input unit which inputs the type of the recording medium, wherein the pre-designated type of recording medium is inputted by the input unit.

5. An image forming apparatus according to claim 1, further comprising a storing unit which stores the type of the recording medium detected by the detecting unit, and wherein in the first mode, the image forming unit forms the image based on the type of the recording medium stored in the storing unit.

6. An image forming apparatus according to claim 1, wherein the detecting unit includes a light irradiating unit which irradiates light to the recording medium, and an imaging unit which photographs a surface image of the recording medium in an area where the light has been irradiated.

7. An image forming apparatus according to claim 1, wherein the detecting unit includes a light irradiating unit which irradiates light to the recording medium, and a detecting unit which detects an amount of light which passes through the recording medium.

8. An image forming apparatus that forms an image according to a type of recording medium, comprising:

an image forming unit which forms the image;

a feeding unit which feeds the recording medium to the image forming unit; and a detecting unit which detects the type of the recording medium, wherein a designating mode for forming the image according to a pre-designated type of the recording medium and a detecting mode for forming the image according to the type of the recording medium which is detected by the detecting unit are switchable, and even in the designating mode, the type of the recording mediums is detected by the detecting unit and a detection result is used in the detecting mode.

9. An image forming apparatus according to claim 8, wherein the detecting unit detects the type of a specified number of recording medium.

10. An image forming apparatus according to claim 8, wherein in the designating mode, the detecting unit detects the type of a first recording medium first fed by the feeding unit.

11. An image forming apparatus according to claim 8, further comprising an input unit which inputs the type of the recording medium, wherein the pre-designated type of recording medium is inputted by the input unit.

12. An image forming apparatus according to claim 8, further comprising a storing unit which stores the type of the recording medium detected by the detecting unit, and wherein in the detecting mode, the image forming unit forms the image based on the type of the recording medium stored in the storing unit.

13. An image forming apparatus according to claim 8, wherein the detecting unit includes a light irradiating unit which irradiates light to the recording medium, and an imaging unit which photographs a surface image of the recording medium in an area where the light has been irradiated.

14. An image forming apparatus according to claim 8, wherein the detecting unit includes a light irradiating unit which irradiates light to the recording medium and, a detecting unit which detects an amount of light which passes through the recording medium.

* * * * *